US005407482A

United States Patent [19]

Kuribayashi et al.

[11] Patent Number: 5,407,482

[45] Date of Patent: Apr. 18, 1995

[54] PRIMER APPLYING AND SURFACE WIPING APPARATUS

[75] Inventors: Masao Kuribayashi; Hajime Yoshino; Ryuichiro Furukawa, all of Sayama, Japan

[73] Assignee: Honda Giken Kogyo Kabushiki Kaisha, Tokyo, Japan

[21] Appl. No.: 982,502

[22] Filed: Nov. 27, 1992

[30] Foreign Application Priority Data

Mar. 30, 1992 [JP] Japan ..... 4-074046

[51] Int. Cl.[6] ..... B05C 1/00

[52] U.S. Cl. ..... 118/72; 118/203; 118/258; 118/679; 118/688

[58] Field of Search ..... 118/70, 72, 109, 110, 118/203, 244, 258, 264, 266, 679, 677, 670, 688; 156/391

[56] References Cited

U.S. PATENT DOCUMENTS

| | | | |
|---|---|---|---|
| 4,147,126 | 4/1979 | Riggs | 118/241 X |
| 4,417,934 | 11/1983 | Vaughan | 118/688 X |
| 4,480,582 | 11/1984 | Schaefer | 118/70 X |
| 4,605,569 | 8/1986 | Shimada et al. | 118/203 X |
| 4,660,501 | 4/1987 | Nagato et al. | 118/266 X |
| 5,045,146 | 9/1991 | Rundo | 156/391 |

FOREIGN PATENT DOCUMENTS

| | | |
|---|---|---|
| 0111206 | 6/1984 | European Pat. Off. . |
| 0391340 | 10/1990 | European Pat. Off. . |
| 62-23613 | 5/1987 | Japan . |
| 1-17912 | 3/1989 | Japan . |
| 1-17912 | 4/1989 | Japan . |
| 1176670 | 1/1970 | United Kingdom . |
| 91/15305 | 10/1991 | WIPO . |

*Primary Examiner*—Michael W. Ball
*Assistant Examiner*—James J. Engel

[57] ABSTRACT

A primer applicator which is movable along a surface of a workpiece such as an automobile window glass panel has a rotatable primer coating roller having an outer circumferential layer of soft resin. A robot arm which supports the primer applicator is actuated to move the primer applicator along the surface of the workpiece in rolling contact therewith to apply a primer to the surface of the workpiece. The primer is supplied to the outer circumferential layer of the primer coating roller when the primer coating roller rolls on the surface of the workpiece.

14 Claims, 15 Drawing Sheets

PRIMER APPLYING AND SURFACE WIPING APPARATUS

BACKGROUND OF THE INVENTION

1. Field of the Invention

The present invention relates to an apparatus for applying a primer as an adhesion assistant to a surface of a workpiece such as an automobile window glass panel, and an apparatus for wiping such a surface before a primer is applied thereto.

2. Description of the Prior Art

Automobile window glass panels are assembled on automobile bodies usually as follows: A primer as an adhesion assistant is applied to the peripheral edge of an automobile window glass panel, and then an adhesive is coated on the peripheral edge of the glass panel over the primer coating. Thereafter, the glass panel is bonded to an automobile body by the adhesive.

Efforts have been made to automate the process of applying a primer to an automobile window glass panel. An example of automatic primer applying apparatus is disclosed in Japanese patent publication No. 62-23613 (corresponding to U.S. Pat. No. 4,605,569).

The disclosed primer applying apparatus has a coating brush for applying a primer to an automobile window glass panel. The coating brush is resiliently supported on the distal end of a robot arm through an air cylinder and a spring. To coat a primer, the coating brush is pressed against the peripheral edge of the glass panel, which is held in a working station, by the robot. Then, while the primer is being supplied to the coating brush, the robot arm is moved along a path that the robot has been trained to follow for thereby moving the coating brush along the peripheral edge of the glass panel to apply a primer coating to the peripheral edge.

Since, however, the coating brush tends to be deformed or some of the primer supplied to the coating brush cakes before being coated to the glass panel, it has been difficult to keep the coating brush in contact with a uniform area of the glass panel, and also to supply a uniform amount of primer to every portion of the coating brush which is to contact the glass panel. For these reasons, the glass panel is liable to have primer coating irregularities. Therefore, it has been necessary to inspect the coated glass surface for such primer coating irregularities or similar defects. If any primer coating irregularities or defects are found, they should be removed as by applying the primer again. These inspecting and mending processes are complex as they require a number of steps and a large expenditure of time and labor.

The coating brush should be frequently serviced or replaced with a new one because of brush deformation or primer caking or solidification. The brush replacement is however laborious and costly.

According to the disclosed primer applying apparatus, when the coating brush is not in use, it is placed in a sealed container and an inert gas is supplied into the container for preventing the primer attached to the coating brush from caking. The disclosed arrangement is however not fully effective to prevent the primer attached to the coating brush from caking because the primer gradually cakes even while the coating brush is moving to the container.

Before a primer is applied to an automobile window glass panel, it is customary practice to wipe the surface of the glass panel to which the primer is to be coated, thus removing dust, fingerprints, or oily films off the glass panel surface.

Japanese patent publication No. 1-17912 shows an automatic apparatus for wiping the surface of an automobile window glass panel to which a primer is to be coated.

The disclosed automatic wiping apparatus has an elongated piece of wiping cloth gripped by a gripper on the distal end of a robot arm and resiliently supported by an air cylinder and a spring. To wipe the glass panel surface, the piece of wiping cloth gripped by the gripper is pressed against the peripheral edge of the glass panel, which is held in a working station, by the robot. Then, while a wiping solution is being supplied to the piece of wiping cloth, the robot arm is moved along a path that the robot has been trained to follow for thereby moving the piece of wiping cloth along the peripheral edge of the glass panel to wipe the peripheral edge.

After the glass panel is wiped by the piece of wiping cloth, it is replaced with a new piece of wiping cloth. More specifically, the used piece of wiping cloth is released from the gripper, and then a new piece of wiping cloth is gripped by the gripper. The new piece of cloth is supplied from a wiping cloth supply. The wiping cloth supply has a coiled web of wiping cloth and a cutter for cutting the web of wiping cloth into an elongated piece of wiping cloth which is to be gripped by the gripper. After having released the used piece of wiping cloth, the gripper grips one end of the coiled web of wiping cloth and pulls it from the wiping cloth supply. The pulled web of wiping cloth is then cut off into a new piece of wiping cloth by the cutter. The gripper now grips the new piece of wiping cloth for use on another automobile window glass panel.

Inasmuch as the gripper grips a piece of wiping cloth, the piece of wiping cloth must have a portion to be gripped by the gripper, in addition to its portion that is used to wipe a glass panel surface. Therefore, the piece of wiping cloth has to be longer than its portion that is actually used for wiping a glass panel surface. The length of wiping cloth that is consumed is large and uneconomical, resulting in an increase in the cost.

The process of wiping cloth replacement is inefficient because it is composed of many steps, i.e., releasing the used piece of wiping cloth from the gripper, gripping and pulling the web of wiping cloth by the gripper, and cutting the web of wiping cloth into a new piece of wiping cloth by the cutter.

SUMMARY OF THE INVENTION

It is therefore an object of the present invention to provide an apparatus for applying a primer reliably uniformly to a surface of a workpiece.

Another object of the present invention is to provide an apparatus for applying a primer to a workpiece while easily and reliably recognizing the condition which the primer is applied to the workpiece.

Still another object of the present invention is to provide an apparatus for applying a primer to a workpiece while efficiently and reliably preventing the primer on a primer applicator from caking.

Yet still another object of the present invention is to provide an apparatus for reliably and efficiently wiping a surface of a workpiece with a wiper before a primer is applied thereto, while reducing the consumption and cost of the primer, and allowing the wiper to be replaced quickly and easily for higher wiping efficiency.

According to the present invention, there is provided an apparatus for applying a primer to a surface of a workpiece in a working station, comprising a primer applicator movable along the surface of the workpiece, the primer applicator having a primer coating roller rotatably supported thereon, the primer coating roller having an outer circumferential layer of soft resin, moving means for moving the primer applicator along the surface of the workpiece in rolling contact therewith to apply the primer to the surface of the workpiece, and primer supply means for supplying the primer to the outer circumferential layer of the primer coating roller when the primer coating roller rolls on the surface of the workpiece.

While the primer coating roller is rolling on the surface of the workpiece, the primer is supplied to the outer circumferential layer of the primer coating roller, and the primer is applied to the surface of the workpiece by the primer coating roller. Since the primer is applied by the primer coating roller as it rolls on the surface of the workpiece, and the primer coating roller is held against the surface of the workpiece through a uniform area, the primer can uniformly be applied to the surface of the workpiece.

The outer circumferential layer of the primer coating roller may be made of a soft porous resin such as cellular ethylene propylene rubber. The primer supplied to the outer circumferential layer is therefore uniformly attached to the outer surface of the layer, and hence can uniformly be applied to the surface of the workpiece.

The moving means may comprise a robot having an arm with the primer applicator mounted on a distal end thereof. The robot may be trained to move the primer applicator along a predetermined path along the surface of the workpiece when the primer is applied to the surface of the workpiece.

The primer coating roller should preferably be supported on the primer applicator for movement substantially perpendicular to the surface of the workpiece, and the primer applicator should preferably have urging means for normally urging the primer coating roller toward the surface of the workpiece. With such an arrangement, even if the path of the primer applicator is not aligned with the surface of the workpiece due to a positional error, the primer coating roller can reliably be pressed against the surface of the workpiece.

In the case where the surface of the workpiece is a peripheral surface of the workpiece, the primer coating roller may be guided to roll on the surface of the workpiece along a peripheral edge of the workpiece.

The apparatus may further comprise first detecting means for detecting a rate at which the primer is supplied from the primer supply means to the primer coating roller when the primer coating roller rolls on the surface of the workpiece, second detecting means for detecting a condition in which the primer coating roller contacts the surface of the workpiece when the primer coating roller rolls on the surface of the workpiece, third detecting means for detecting a condition in which the primer coating roller rotates when the primer coating roller rolls on the surface of the workpiece, fourth detecting means for detecting whether a primer coated layer is formed on the surface of the workpiece after the primer coating roller has rolled on the surface of the workpiece, and processing means for determining whether the primer is well applied to the surface of the workpiece based on detected signals from the first through fourth detecting means.

If the primer coating roller is in proper contact with the surface of the workpiece, if the primer coating roller rotates properly on the surface of the workpiece, and if the primer is supplied at a suitable rate to the outer circumferential layer of the primer coating roller, then the primer is considered as being uniformly applied to the surface of the workpiece. Since the primer is apt to cake easily, however, the primer may not be sufficiently applied to the glass panel if the primer supplied to the outer circumferential surface of the primer coating roller cakes and is not applied to the workpiece surface.

When the primer is applied to the workpiece, it is detected whether the primer coating roller is in proper contact with the surface of the workpiece, whether the primer coating roller rotates properly on the surface of the workpiece, whether the primer is supplied at a suitable rate to the outer circumferential layer of the primer coating roller, and whether a primer coated layer is formed on the surface of the workpiece after the primer coating roller has rolled thereon. Based on the detected results, it can easily be determined whether the primer is well applied to the surface of the workpiece.

Inasmuch as the primer applicator is moved by the robot along the predetermined path along the surface of the workpiece and the primer coating roller is movable substantially perpendicularly to the surface of the workpiece and normally urged thereagainst, the condition in which the primer coating roller contacts the surface of the workpiece can easily be detected by detecting the position of the primer coating roller with respect to the primer applicator.

The condition in which the primer coating roller rotates when it applies the primer to the surface of the workpiece can easily be detected by detecting the rotational speed of the primer coating roller.

Generally, the primer is relatively glossy immediately after it is applied to the workpiece surface, and hence tends to reflect light applied thereto. As time goes on, the applied primer diffuses more light which is applied thereto. Therefore, immediately after the primer is applied to the workpiece surface, light is applied to the workpiece surface, and it is determined whether light is reflected from the workpiece surface. Based on the reflected light, it can be determined whether a primer coated layer has been formed on the workpiece surface.

The moving means comprises means for moving the primer applicator from the working station to a standby station after the primer has been applied to the surface of the workpiece in the working station, the primer applicator having cleaning means for removing the primer which remains attached to the primer coating roller when the primer applicator has been moved to the standby station.

The cleaning means comprises a cleaning roller rotatably mounted in a position in which the outer circumferential layer of the primer coating roller can be pressed against the cleaning roller by the moving means when the primer applicator has been moved to the standby station, actuating means for rotating the cleaning roller when the primer coating roller is pressed against the cleaning roller, and cleaning solution supply means for supplying a cleaning solution to a region where the primer coating roller is pressed against the cleaning roller when the cleaning roller is rotated by the actuating means.

Between primer coating cycles, the cleaning roller is pressed against the outer circumferential layer of the primer coating roller, and is rotated while the cleaning solution is supplied to the region where the cleaning roller is pressed against the primer coating roller. The primer which has been attached to the outer circumferential layer of the primer coating roller flows out of the outer circumferential layer, and is removed by the supplied cleaning solution. Therefore, the primer which has been attached to the outer circumferential layer of the primer coating roller is washed away, and is prevented from caking on the primer coating roller between the primer coating cycles. The next primer coating cycle is therefore not adversely affected by primer caking.

The cleaning roller is rotated while an outer circumferential surface thereof is being immersed in the cleaning solution. In this manner, when the cleaning roller is rotated, the cleaning solution is supplied to the region where the cleaning roller is pressed against the primer coating roller.

The cleaning roller is disposed in the position such that the cleaning roller has an axis inclined to the axis of the primer coating roller when the cleaning roller is pressed against the primer coating roller. The primer coating roller is rubbed by the outer circumferential surface of the cleaning roller under thrust forces, so that the outer circumferential layer of the primer coating roller can reliably be cleaned.

According to the present invention, there is also provided an apparatus for wiping a surface of a workpiece before a primer is applied to the surface of the workpiece in a working station, comprising a wiper movable along the surface of the workpiece, holding means mounted on the wiper for holding a coiled elongate web of wiping material while allowing the web of wiping material to be pulled out, clamp means mounted on the wiper for releasably clamping a leading end of the web of wiping material which is pulled out of the holding means, pressing means mounted on the wiper for pressing a predetermined region of the web of wiping material slidably in pressing contact with the surface of the workpiece while tensioning the web of wiping material between the holding means and the clamp means when the wiper is moving along the surface of the workpiece, moving means for moving the wiper along the surface of the workpiece when the surface of the workpiece is wiped, wiping solution supply means for supplying a wiping solution to the surface of the workpiece before the web of wiping material slides on the surface of the workpiece, pulling means for gripping and pulling the distal end of the web of wiping material out of the clamp means when the web of wiping material is released from the clamp means after the surface of the workpiece is wiped, and cutting means for cutting off the web of wiping material which has been pulled by the pulling means.

When the wiper is moved along the surface of the workpiece by the moving means, the web of wiping material is pressed against the workpiece surface by the pressing means while under tension between the holding means and the clamp means. As the wiper moves, the web of wiping material slides on the workpiece surface. At this time, the surface of the workpiece is supplied with the wiping solution from the wiping solution supply means before the web of wiping material comes into sliding contact with the web of wiping material. The workpiece surface supplied with the wiping solution is then wiped by the web of wiping material pressed thereagainst, so that dust, fingerprints, or oily films can be removed from the workpiece surface.

The web of wiping material is unwindably wound on a reel of the holding means, and pressed against the workpiece surface by a pressing member pressed which is against the web of wiping material toward the surface of the workpiece between the holding means and the clamp means.

To tension the web of wiping material between the holding means and the clamp means, the reel is locked against rotation and the web of wiping material is urged away from the reel, or the reel is urged to rotated in a direction opposite to the direction in which the reel rotates to unwind the web of wiping material. To rotate the reel in that direction, it is preferable to urge the reel through a frictional engagement member held in frictional engagement with the reel for rotation therewith. In this fashion, the web of wiping material can easily be tensioned between the reel and the clamp means, and can easily be pulled out simply by imparting a pulling force to the web of wiping material against the frictional force applied by the frictional engagement member.

The pressing member should preferably be mounted on the wiper for movement substantially perpendicular to the surface of the workpiece, and normally urged toward the surface of the workpiece. The web of wiping material can thus reliably be pressed against the workpiece surface for reliably wiping the workpiece surface. After the workpiece surface has been wiped, the leading end of the web of wiping material which is unclamped by the clamp means is gripped by the pulling means, and pulled out of the clamp means. The clamp means may comprise a first roller having a one-way clutch to allow the first roller to rotate only in a direction to pull out the web of wiping material, and a second roller rotatable with the web of wiping material being gripped between the first roller and the second roller. With this arrangement, the web of wiping material can be released from the clamp means simply by applying a pulling force to the web of wiping material.

When the web of wiping material is pulled, an unused portion thereof is pulled from the holding means and shifted into a region in which it is pressed against the workpiece surface between the holding means and the clamp means. The interval by which the web of wiping material is pulled out may be relatively small because the web of wiping material may be pulled until the unused portion of the web of wiping material reaches the region where it is pressed against the workpiece surface. Accordingly, the web of wiping material can quickly be pulled from the holding means. Since the unused portion of the web of wiping material which is contiguous to the used portion thereof is used to wipe a new workpiece surface, the web of wiping material can efficiently be consumed wastelessly. The used portion of the web of wiping material which has been pulled out of the clamp means is cut off by the cutting means.

The apparatus for wiping a workpiece surface should preferably be combined with the apparatus for applying a primer to a workpiece surface. In such a combination, the primer applicator and the wiper may be coupled to each other, and the primer coating roller and the web of wiping material may be mounted thereon. The primer applicator and the wiper thus coupled to each other may be moved by one moving means such as a single robot. The pressing material for being pressed against the web of wiping member may be moved closer to the workpiece surface than the primer coating roller when the workpiece surface is wiped, and moved further from the workpiece surface than the primer coating roller when the primer is applied to the workpiece surface. In this manner, the surface wiping process and the primer applying process can successively be carried out smoothly.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

FIGS. 1 through 11(*a*) and 11(*b*) show a primer applying and surface wiping apparatus according to a first embodiment of the present invention.

Figure 1:
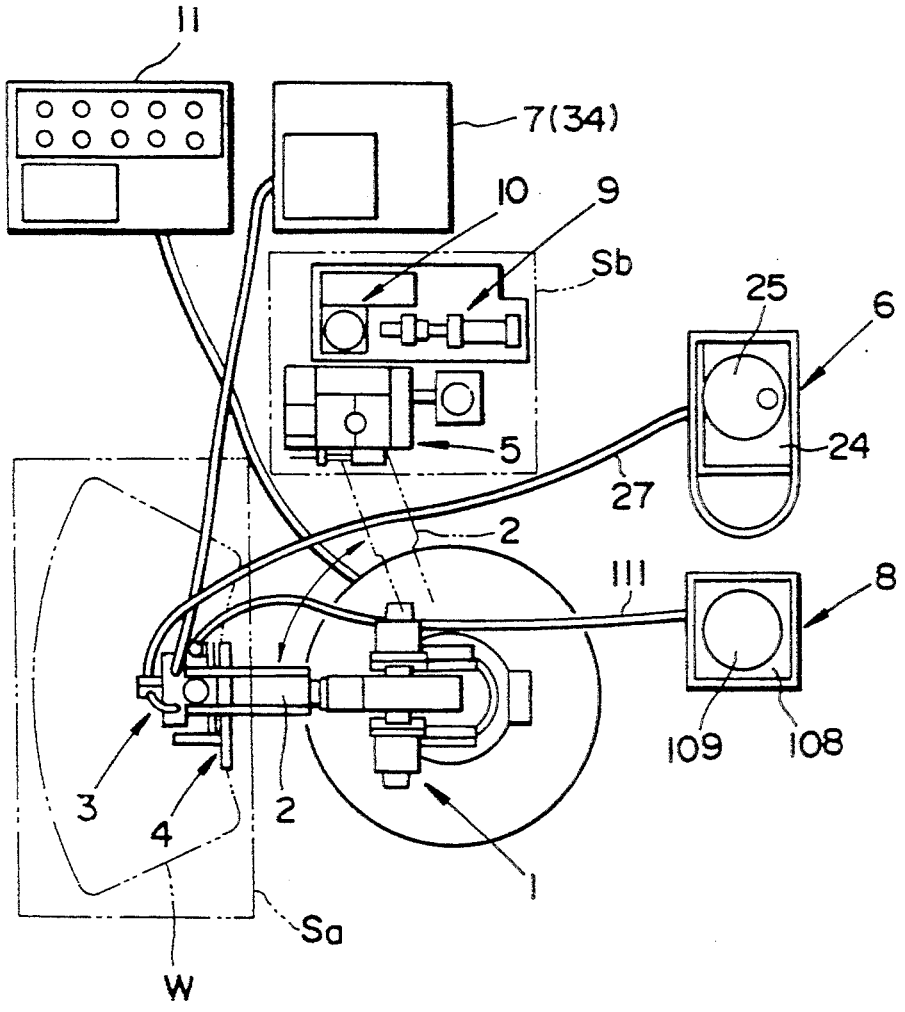
FIG. 1 is a plan view of a primer applying and surface wiping apparatus according to a first embodiment of the present invention.

In FIG. 1, the principles of the present invention are embodied in a combination of a primer applying apparatus for applying a primer to a workpiece W such as an automobile window glass panel (hereinafter referred to as a "glass panel") and a surface wiping apparatus for wiping a surface of the glass panel W before the primer is applied thereto. As shown in FIG. 1, the primer applying and surface wiping apparatus generally comprises a robot 1 having an arm 2 movable three-dimensionally in any direction with a primer applicator 3 and a wiper 4 mounted on its distal end, a cleaning device 5 for cleaning a primer coating roller of the primer applicator 3, a primer supply device 6 for supplying a primer to the primer coating roller, a controller 7 for monitoring the condition in which a primer is applied to the glass panel W and determining whether the primer is well applied to the glass panel W or not, a wiping solution supply device 8 for supplying a wiping solution to a surface of the glass panel W to which the primer will be applied, when the surface of the glass panel W is wiped, a pulling device 9 for pulling an elongate web of wiping material or cloth toward the wiper 4, a cutting device 10 for cutting off the web of wiping material which has been pulled by the pulling device 9, and a main controller 11 for controlling the robot 1 and other devices and components of the primer applying and surface wiping apparatus.

The glass panel W is held substantially horizontally by a suitable holder (not shown) in a working station Sa. The surface of the glass panel W to which the primer will be applied faces upwardly in the working station Sa. The primer applicator 3 and the wiper 4 are movable between the working station Sa and an adjacent standby station Sb by the arm 2 of the robot 1 which is controlled by the main controller 11. In the working station Sa, the arm 2 is moved to displace the primer applicator 3 and the wiper 4 along a path that the robot 1 has been trained to follow, above a peripheral edge of the glass panel W. The cleaning device 5, the pulling device 9, and the cutting device 10 are positioned in the standby station Sb. In the standby station Sb, the arm 2 moves the primer applicator 3 and the wiper 4 toward the cleaning device 5, the pulling device 9, and the cutting device 10.

First, various components of the apparatus which are involved in applying the primer to the glass panel W will be described below.

As shown in FIGS. 2 through 5, the primer applicator 3 has a frame 12 attached to the distal end of the arm 2, and a primer coating roller 13 supported on the frame 12.

Figure 3:
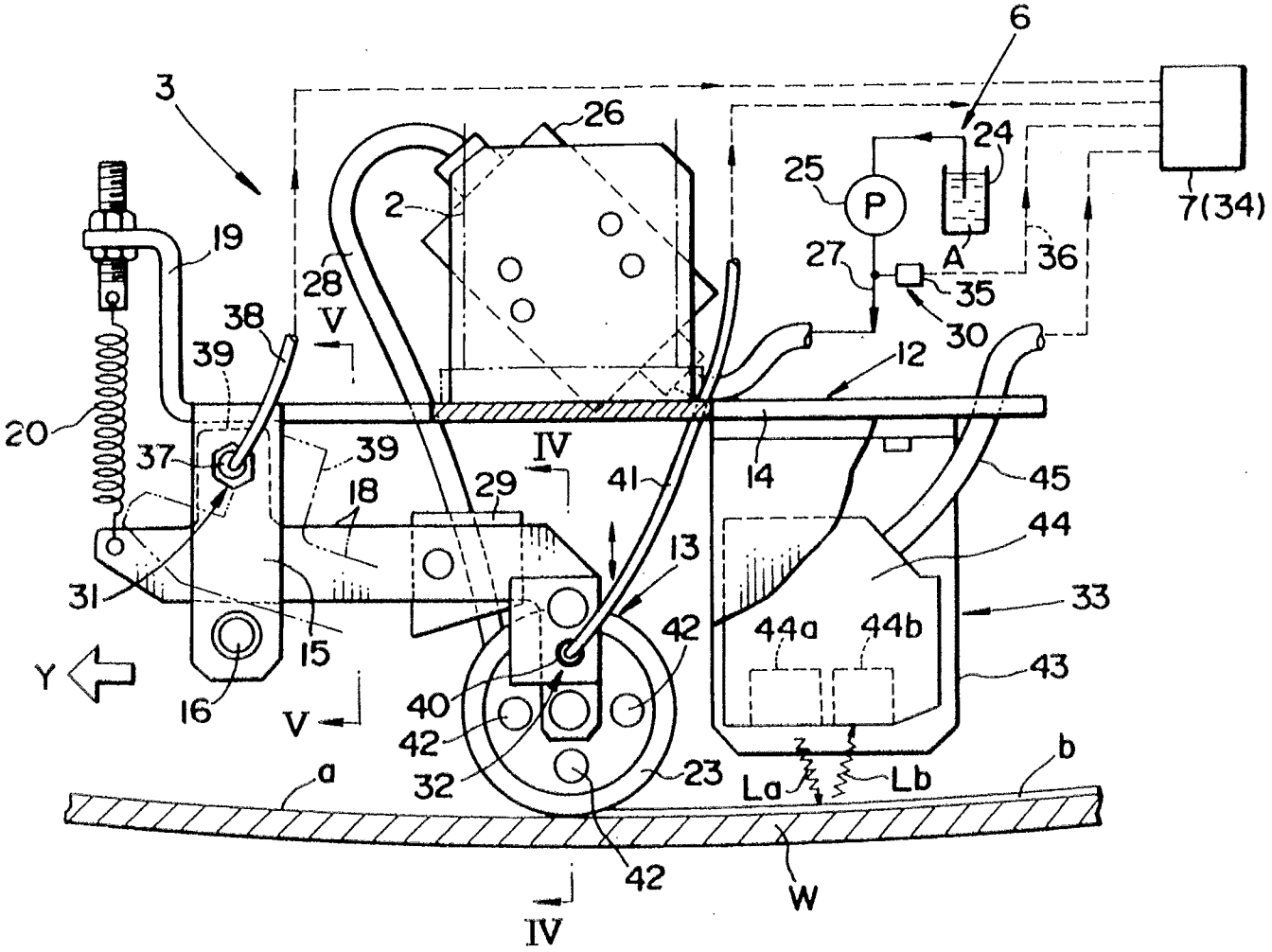
FIG. 3 is an enlarged cross-sectional view taken along line III—III of FIG. 2.
Figure 4:
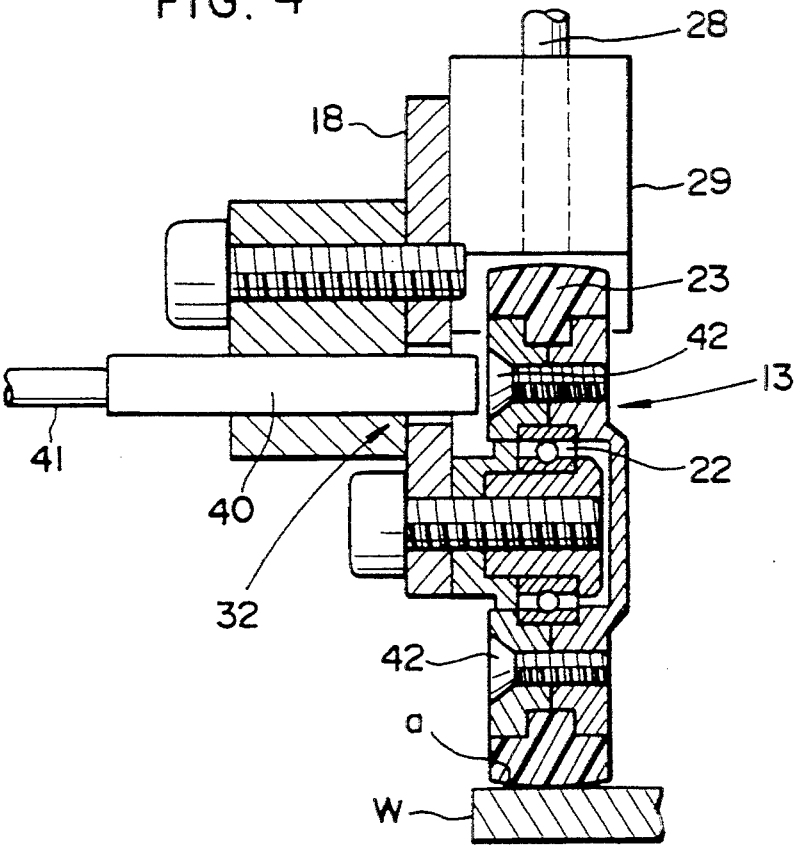
FIG. 4 is an enlarged cross-sectional view taken along line IV—IV of FIG. 3.
Figure 5:
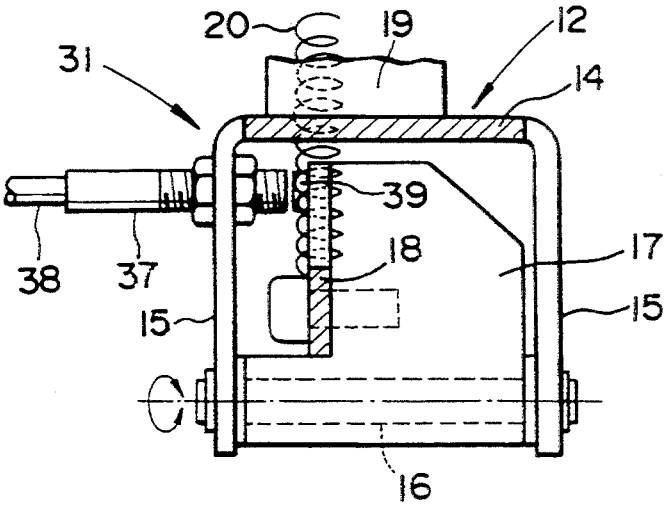
FIG. 5 is an enlarged cross-sectional view taken along line V—V of FIG. 3.

As shown in FIGS. 3 through 5, the frame 12 comprises a main plate 14 extending perpendicularly to the arm 2 and having its upper surface fixedly joined to the arm 2, a pair of auxiliary plates 15 extending downwardly from opposite sides of the main plate 14 near its distal end, a support shaft 16 supported by the auxiliary plates 15 and extending between lower ends thereof transversely of the main plate 14, i.e., in a direction perpendicular to the sheet of FIG. 3, and a swing plate 18 extending along the main plate 14 from a block 17 angularly movably supported on the support shaft 16, the swing plate 18 being swingably supported on the support shaft 16 through the block 17. As shown in FIG. 3, a coil spring 20 is connected between a front end (lefthand end) of the swing plate 18 which is positioned beyond the auxiliary plates 15 and an upper end of a raised portion 19 extending upwardly from the distal end of the main plate 14. The swing plate 18 is normally urged by the coil spring 20 to displace its front end upwardly, i.e., to displace a rear end (righthand end) thereof downwardly about the support shaft 16.

Figure 2:
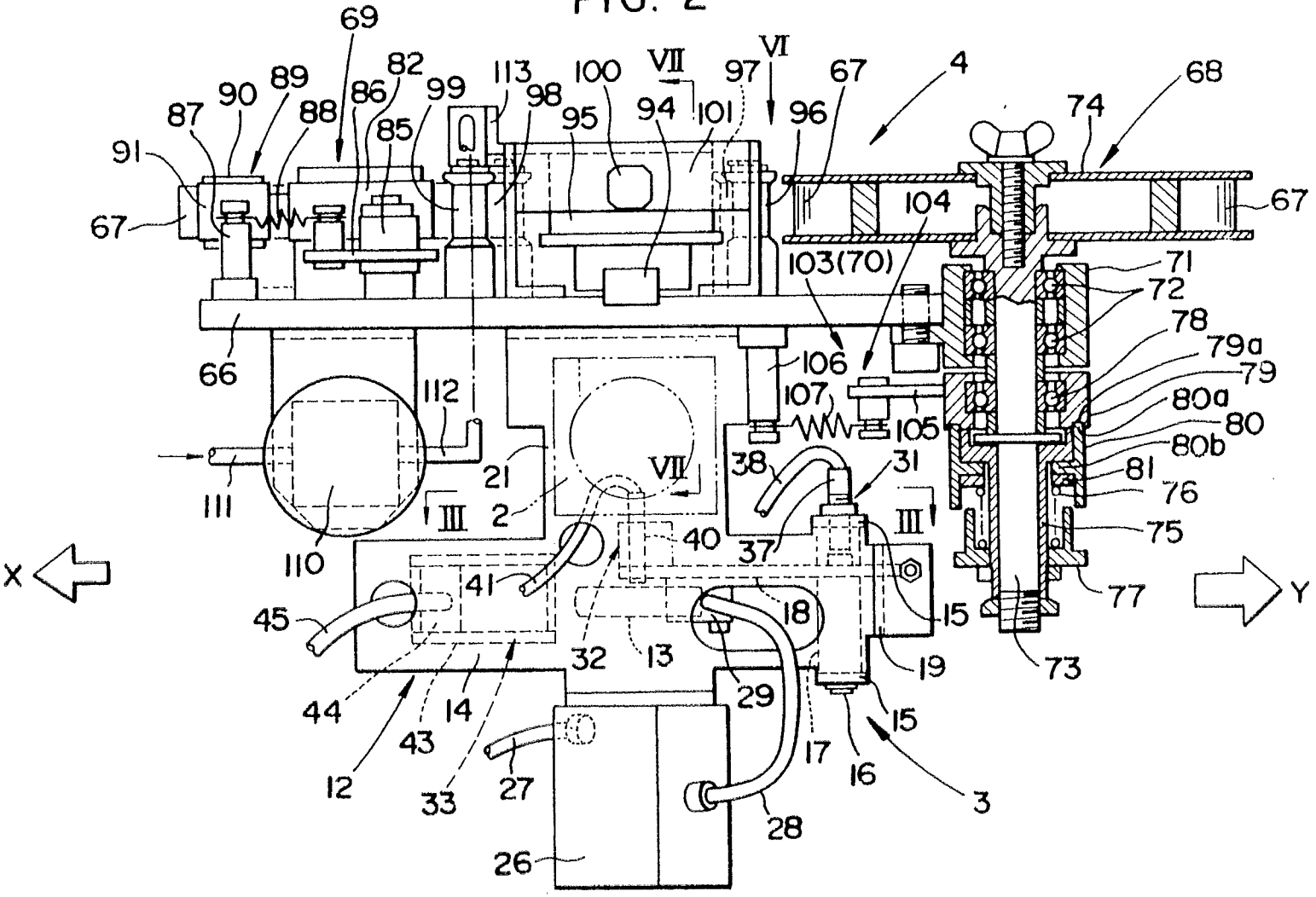
FIG. 2 is an enlarged plan view, partly in cross section, of a portion of the primer applying and surface wiping apparatus shown in FIG. 1.

As shown in FIG. 2, the main plate 14 has a transverse extension 21 extending transversely from a side edge thereof and attached to the distal end of the arm 2. The wiper 4 is mounted on a distal end of the transverse extension 21. The wiper 4 will be described in detail later on.

As shown in FIGS. 3 and 4, the primer coating roller 13 is rotatably supported on the rear end of the swing plate 18 by a bearing 22, so that the primer coating roller 13 is angularly movable with the swing plate 18 about the support shaft 16. When the surface a of a peripheral edge of the glass panel W is to be coated with a primer, the primer coating roller 13 is placed on the surface a, and pressed against the surface a under the bias of the coil spring 20 for rolling movement on the surface a. The primer coating roller 13 has an outer circumferential layer 23 which may be made of a soft porous resin material such as cellular ethylene propylene rubber or a porous resin material having small surface irregularities, insofar as the primer can uniformly be attached to the outer circumferential layer 23.

As shown in FIGS. 1 and 3, the primer supply device 6 comprises a storage tank 24 for storing a primer A, a fluid passage 27 extending from the storage tank 24 through a pump 25 to an on-off valve 26 fixedly mounted on the main plate 14 of the primer applicator 3, and a primer supply pipe 28 connected to the fluid passage 27 through the on-off valve 26. The primer supply pipe 28 extends from the on-off valve 26 to a position near the outer circumferential surface of the primer coating roller 13, and has its distal end supported by a support 29 fixed to a rear end portion of the swing plate 18. The primer supply device 6 supplies the primer A from the storage tank 24 through the pump 25, the fluid passage 27, the on-off valve 26, and the primer supply pipe 28 to the outer circumferential surface of the primer coating roller 13. The fluid passage 27 may comprise a fluid supply pipe.

As shown in FIGS. 3 through 5, the controller 7 is supplied with signals from a first detector 30 for detecting the rate at which the primer A is supplied from the primer supply device 6 to the primer coating roller 13, a second detector 31 for detecting whether the primer coating roller 13 is in good contact with the glass panel W when the primer A is applied to the glass panel W, a third detector 32 for detecting whether the primer coating roller 13 is rotated when the primer A is applied to the glass panel W, and a fourth detector 33 for detecting a coated layer b of the primer A applied to the glass panel W. The controller 7 serves as a processor for determining whether the primer A is well applied to the glass panel W based on the signals supplied from the first, second, third and fourth detectors 30, 31, 32, 33.

As shown in FIG. 3, the first detector 30 comprises a pressure sensor 35 connected to the fluid passage 27 downstream of the pump 25, the pressure sensor 35 being electrically coupled to the controller 7 through an electric cable 36. If the fluid passage 27 is normal, i.e., free of clogs, the pressure, as detected by the pressure sensor 35, at which the primer A is supplied by the pump 25 is lower when the on-off valve 26 is open than when it is closed. The difference between the pressure when the on-off valve 26 is open and the pressure when it is closed is relatively large. However, if the fluid passage 27 is clogged, then any pressure difference developed when the on-off valve 26 is switched from the closed condition to the open condition is smaller than if the fluid passage 27 is free of clogs. By thus detecting such pressure difference with the pressure sensor 35, the first detector 30 indirectly determines whether the primer A is supplied at a proper rate or not. Of course, it is possible to directly determine whether the primer A is supplied at a proper rate or not, using a flow rate sensor.

As shown in FIGS. 3 and 5, the second detector 31 comprises a proximity switch 37 fixed to an upper potion of one of the auxiliary plates 15 and extending horizontally through the auxiliary plate 15. The proximity switch 37 is electrically coupled to the controller 7 through an electric cable 38. The swing plate 18 supports, on its surface facing the auxiliary plate 15 supporting the proximity switch 37, a detectable member 39 which confronts the proximity switch 37 only when the swing plate 18 swings into a position in which the primer coating roller 13 is properly supported on the surface a of the glass panel W as shown in FIG. 3. The proximity switch 37 does not produce a signal when the detectable member 39 confronts the proximity switch 37. The proximity switch 37 produces and applies a signal to the controller 7 when the swing plate 18 swings into a position in which the detectable member 39 is positioned away from the proximity switch 37.

Therefore, the angular position of the swing plate 18, i.e., the angular position of the primer coating roller 13, which swings with the swing plate 18, with respect to the frame 12 is detected by the proximity switch 37, thus detecting the condition in which the primer coating roller 13 contacts the glass panel W when the primer A is applied to the glass panel W by the primer coating roller 13. Specifically, when no signal is generated by the proximity switch 37 while the primer A is being applied to the glass panel W by the primer coating roller 13, it is detected that the primer coating roller 13 is in proper contact with the glass panel W. When the proximity switch 37 produces a signal, it is detected that the primer coating roller 13 is not in proper contact with the glass panel W.

As illustrated in FIGS. 3 and 4, the third detector 32 has a rotation sensor 40 fixedly mounted on the rear end of the swing plate 18 and directed toward a side surface of the primer coating roller 13. The rotation sensor 40 is electrically coupled to the controller 7 through an electric cable 41. The side surface of the primer coating roller 13 which faces the rotation sensor 40 has a plurality of detectable members 42 spaced at circumferentially equal intervals. The rotation sensor 40 sends an output pulse to the controller 7 each time it faces one of the detected members 42 when the primer coating roller 13 rotates. The controller 7 counts output pulses from the rotation sensor 40 during a certain period of time to detect the rotational speed of the primer coating roller 13, thus determining the position for the primer coating roller 13. The total number of output pulses that are produced by the rotation sensor 40 while the primer coating roller 13 moves around the surface a of the peripheral edge of the glass panel W can be determined by an experiment. Therefore, when the actual total number of output pulses produced by the rotation sensor 40 while the primer coating roller 13 moves around the surface a of the peripheral edge of the glass panel W is compared with a predetermined number of pulses, the controller 7 can detect any possible dirt deposit between the glass panel W and the prime coating roller 13 or a wear of the prime coating roller 13.

In FIG. 3, the fourth detector 33 comprises an optical detector 44 fixed to a downwardly projecting bracket 43 attached to the main frame 14 behind the primer coating roller 13. The optical detector 44 is electrically connected to the controller 7 through an electric cable 45. The optical detector 44 comprises a light-emitting element 44*a* for applying a light beam La to the surface a of the glass panel W after it has been coated by the primer coating roller 13, and a light-detecting element 44*b* for detecting a reflected light beam Lb and applying a signal indicative of the detected light beam Lb to the controller 7. The fourth detector 34 serves to detect whether a primer layer b is coated on the glass panel W based on whether the light-detecting element 44*b* has detected a reflected light beam Lb or not.

In response to detected signals from the pressure sensor 35, the proximity switch 37, the rotation sensor 40, and the light-detecting element 44*b* of the optical detector 44, the controller 7 determines whether the primer A is well coated on the glass panel W or not, and outputs the determined result to a display unit or the like.

Figure 8:
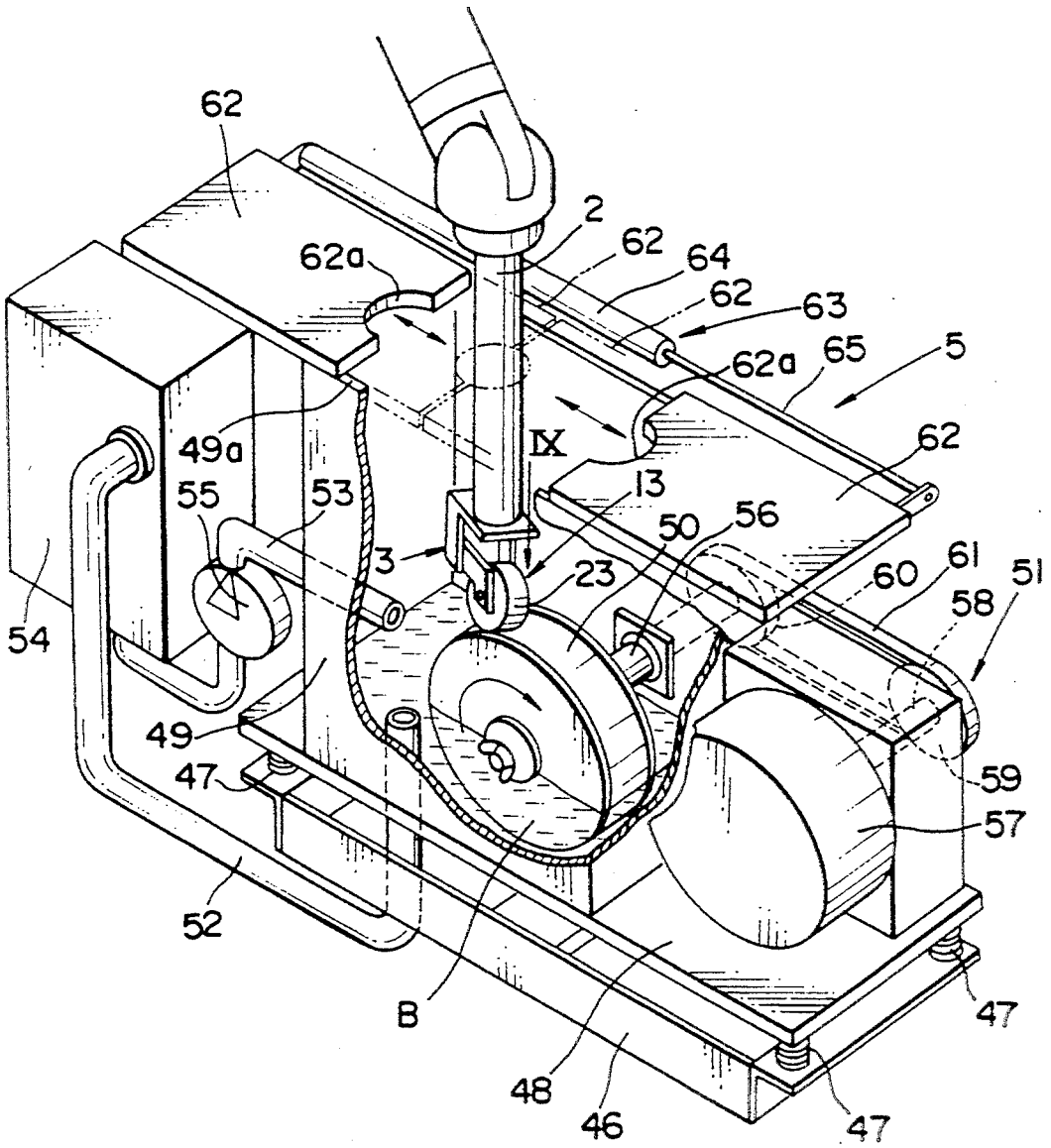
FIG. 8 is a perspective view, partly broken away, of a device for cleaning a primer coating roller in the apparatus shown in FIG. 1.

The cleaning device 5 for cleaning the primer coating roller 13 will be described below with reference to FIGS. 1, 8, and 9. In FIG. 8, only the primer applicator 3 mounted on the arm 2 is schematically illustrated and the wiper 4 is omitted from illustration.

As shown in FIG. 8, the cleaning device 5 has an auxiliary base 48 resiliently supported by springs 47 on a main base 46 disposed in the standby station Sb (see FIG. 1), a cleaning solution tank 49 fixedly mounted on the auxiliary base 48, a cleaning roller 50 rotatably disposed in the cleaning solution tank 49, an actuator 51 for rotating the cleaning roller 50, an auxiliary tank 54 connected to the cleaning solution tank 49 through a pair of pipes 52, 53, and a pump 55 connected in the pipe 53. The cleaning solution tank 49 and the auxiliary tank 54 store a cleaning solution B such as of ethyl acetate for removing the primer. As described later on, the cleaning solution tank 49, the actuator 51, and other members jointly serve as cleaning solution supply means for supplying the cleaning solution B to a region where the primer coating roller 13 is pressed against the cleaning roller 50.

The cleaning roller 50 is concentrically secured to an inner end of a rotatable shaft 56 which extends through and is rotatably supported by a side wall of the cleaning solution tank 49, so that the cleaning roller 50 can rotate with the rotatable shaft 56. The cleaning roller 50 has a lower portion immersed in the cleaning solution B in the cleaning solution tank 49. The cleaning roller 50 has an outer circumferential layer made of felt or the like which can retain the cleaning solution B.

The actuator 51 comprises a motor 57 fixedly mounted on the auxiliary base 48 laterally of the cleaning solution tank 49, a drive pulley 59 mounted on a drive shaft 58 of the motor 57, a driven pulley 60 mounted on an outer end of the rotatable shaft 56 which is positioned out of the cleaning solution tank 49, and a pulley belt 61 trained around the drive and driven pulleys 59, 60. Drive power from the motor 57 is transmitted through the drive shaft 58, the drive pulley 59, the pulley belt 61, the driven pulley 60, and the rotatable shaft 56 to the cleaning roller 50 for thereby rotating the cleaning roller 60.

The auxiliary tank 54, the pipes 52, 53, and the pump 55 serve to circulate the cleaning solution B between the auxiliary tank 54 and the cleaning solution tank 49. When the pump 55 is actuated, the cleaning solution B in the cleaning solution tank 49 is circulated through the pipe 52, the auxiliary tank 54, and the pipe 53. The auxiliary tank 54 has a filter (not shown) disposed therein for filtering the cleaning solution B as it is circulated in its circulation path.

The cleaning solution tank 49 opens upwardly through an upper open end 49*a* on which a pair of openable and closable covers 62 are movably supported. The covers 62 are slidably toward and away from each other on the open end 49*a*. When the covers 62 slide toward each other, they close the cleaning solution tank 49. When the covers 62 slide away from each other, they open the cleaning solution tank 49 upwardly. When the arm 2 is moved into the standby station Sb, the arm 2 inserts the primer applicator 3 downwardly into the cleaning solution tank 49 while it is open, as shown in FIG. 8. At this time, the primer coating roller 13 of the primer applicator 3 is pressed against an upper outer circumferential surface of the cleaning roller 50.

The covers 62 are associated with a cylinder assembly 63 for opening and closing these covers 62. More specifically, the cylinder assembly 63 has a cylinder 64 joined to one of the covers 62 and a piston rod 65 movably projecting out of the cylinder 64 and joined to the other cover 62. As the piston rod 65 is projected out of or retracted back into the cylinder 64, the covers 62 are opened or closed. The opening movement of the covers 62 away from each other is limited by stoppers (not shown). The closing movement of the covers 62 toward each other is limited when semicircular recesses 62*a* defined in the confronting edges of the covers 62 are fitted over the arm 2 which is inserted into the cleaning solution tank 49.

Figure 9:
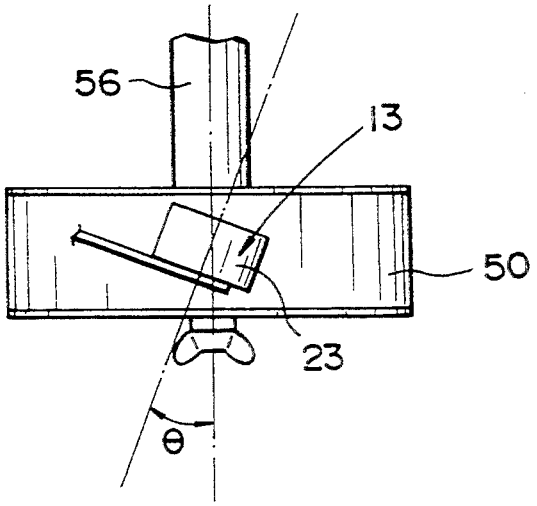
FIG. 9 is a plan view of the primer coating roller as viewed in the direction indicated by the arrow IX in FIG. 8.

When the arm 2 is inserted into the cleaning solution tank 49 and the primer coating roller 13 is pressed against the cleaning roller 50, as shown in FIG. 9, the primer coating roller 13 has its axis inclined to the axis of the cleaning roller 50 by a predetermined angle of Θ.

Various components of the apparatus which are involved in wiping the glass panel W will be described below.

Figure 6:
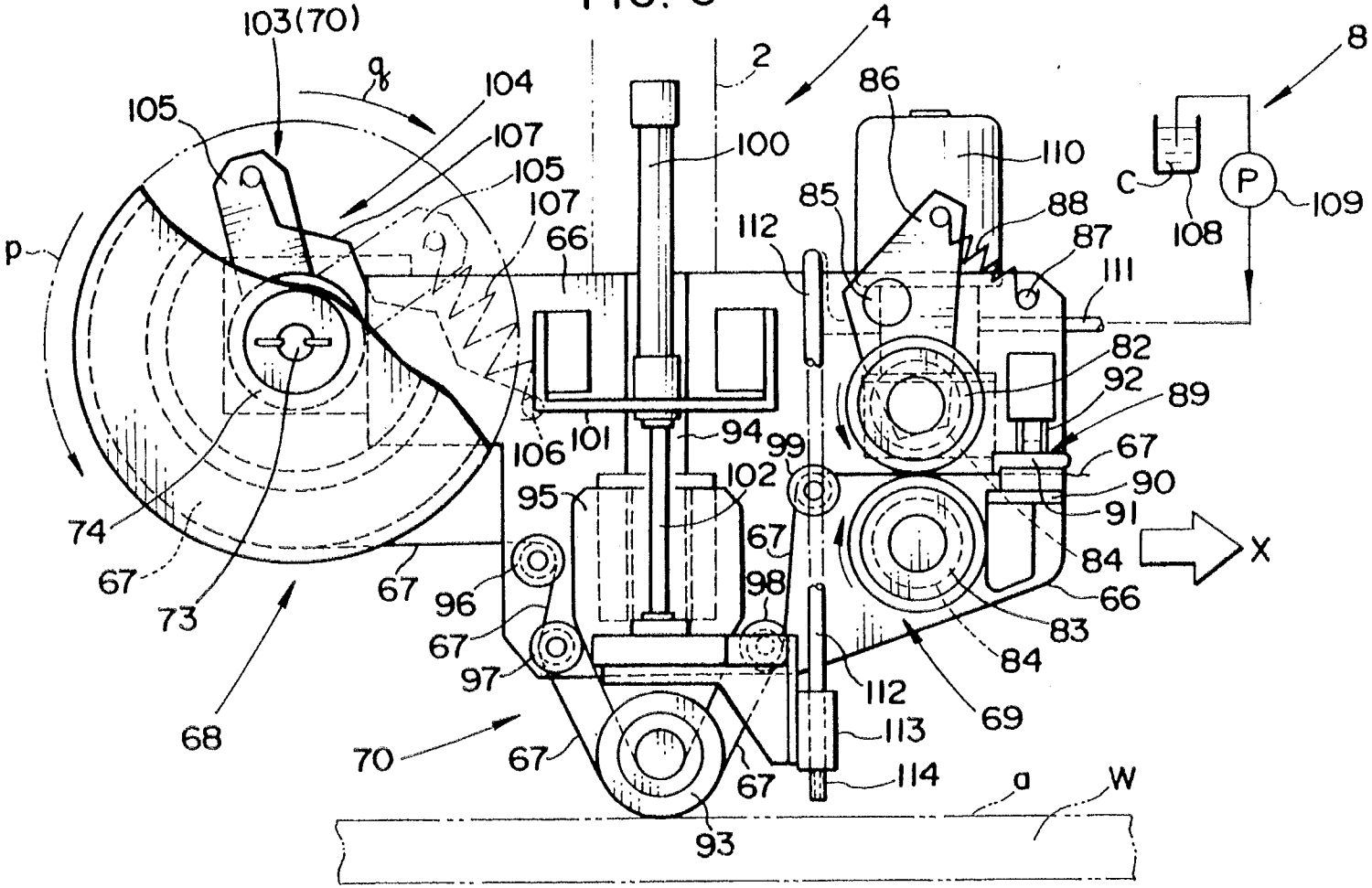
FIG. 6 is a side elevational view of a primer applicator as viewed in the direction indicated by the arrow VI in FIG. 2.

As shown in FIGS. 2 and 6, the wiper 4 has a base plate 66 positioned laterally of the primer applicator 3 and fixed vertically to the distal end of the extension 21 of the frame 12. On the base plate 66, there are mounted a holder 68 for holding a coiled elongate web of wiping cloth (wiping material) 67, a clamp 69 for clamping the leading end of the web of wiping cloth 67, and a presser 70 for pressing the web of wiping cloth 67 against the glass panel W while keeping the web of wiping cloth 67 under tension between the holder 68 and the clamp 69.

As shown in FIG. 2, the holder 68 comprises a rotatable shaft 73 rotatably supported by a bearing 72 in a support member 71 that is fixed to a rear end (righthand end in FIG. 2) of the base plate 66, and a reel 74 detachably mounted on a front end (upper end in FIG. 2) of the rotatable shaft 73. The web of wiping cloth 67 is wound on the reel 74.

The holder 68 also has a tubular rotatable member 75 corotatably mounted on a rear end (lower end in FIG. 2) of the rotatable shaft 73, a first tubular member 77 corotatably mounted on the rotatable member 75, a spring 76 disposed around the rotatable member 75 and acting on the first tubular member 77, a second tubular member 79 rotatably mounted on the rotatable shaft 73 by a bearing 78 and spaced axially from the first tubular member 77 and the support member 71, a tubular frictional engagement member 80 disposed axially between the second tubular member 79 and the first tubular member 77 and positioned radially outwardly of the rotatable member 75, and an annular friction plate 81 biased by the spring 76 to slide axially with respect to and rotatable in unison with the rotatable member 75. The frictional engagement member 80 has an axial projection 80*a* on its end near the second tubular member 79, the axial projection 80*a* being fitted in a recess 79*a* defined in a confronting end face of the second tubular member 79. Therefore, the frictional engagement member 80 is rotatable in unison with the second tubular member 79. The frictional engagement member 80 also has a radially inwardly extending annular flange 80*b* pressed against the annular friction plate 81 which is biased by the spring 76. The frictional engagement member 80 is therefore normally urged into frictional engagement with the rotatable shaft 73 through the annular friction plate 81 and the rotatable member 75.

As shown in FIG. 6, the clamp 69 comprises a first roller 82 rotatably supported on a front end portion (righthand end portion in FIG. 6) of the base plate 66, and a second roller 83 rotatably supported on the base plate 66 underneath the first roller 82 in confronting relationship thereto. The web of wiping cloth 67 unwound from the reel 74 is gripped between the first and second rollers 82, 83.

Each of the first and second rollers 82, 83 has a built-in one-way clutch 84 which allows the first and second rollers 82, 83 to rotate only in a direction to pull the web of wiping cloth 67. When the reel 74 and the first and second rollers 82, 83 are rotated, the web of wiping cloth 67 gripped by these rollers 82, 83 is pulled forwardly in the direction indicated by the arrow X. However, the web of wiping cloth 67 gripped by the first and second rollers 82, 83 are clamped against movement in a direction opposite to the direction X.

The first roller 82 is supported on a lower end of a swing arm 86 which is swingably supported on the base plate 66 by a support shaft 85. The swing arm 86 is normally urged to turn in a direction to press the first roller 82 against the second roller 83 under the bias of a coil spring 88 that is connected under compression between the upper end of the swing arm 86 and a pin 87 mounted on the base plate 66. Therefore, the web of wiping cloth 67 is reliably gripped between the first and second rollers 82, 83 that are spring-biased against each other.

The clamp 69 also has a positioner 89 for holding the leading end of the web of wiping cloth 67 which projects from between the first and second rollers 82, 83.

The positioner 89 includes a table 90 fixed to the base plate 66, a presser spring 92 having an upper end fixed to the base plate 66 above the table 90, and a pad 91 mounted on the lower end of the presser spring 92. The pad 91 is normally urged under the bias of the presser spring 92 against the table 90 for sandwiching the leading end of the web of wiping cloth 67 therebetween while allowing sliding movement thereof. The positioner 89 simply serves to hold the leading end of the web of wiping cloth 67 in position, and permits the web of wiping cloth 67 to be pulled out while it is being sandwiched between the pad 91 and the table 90.

Figure 7:
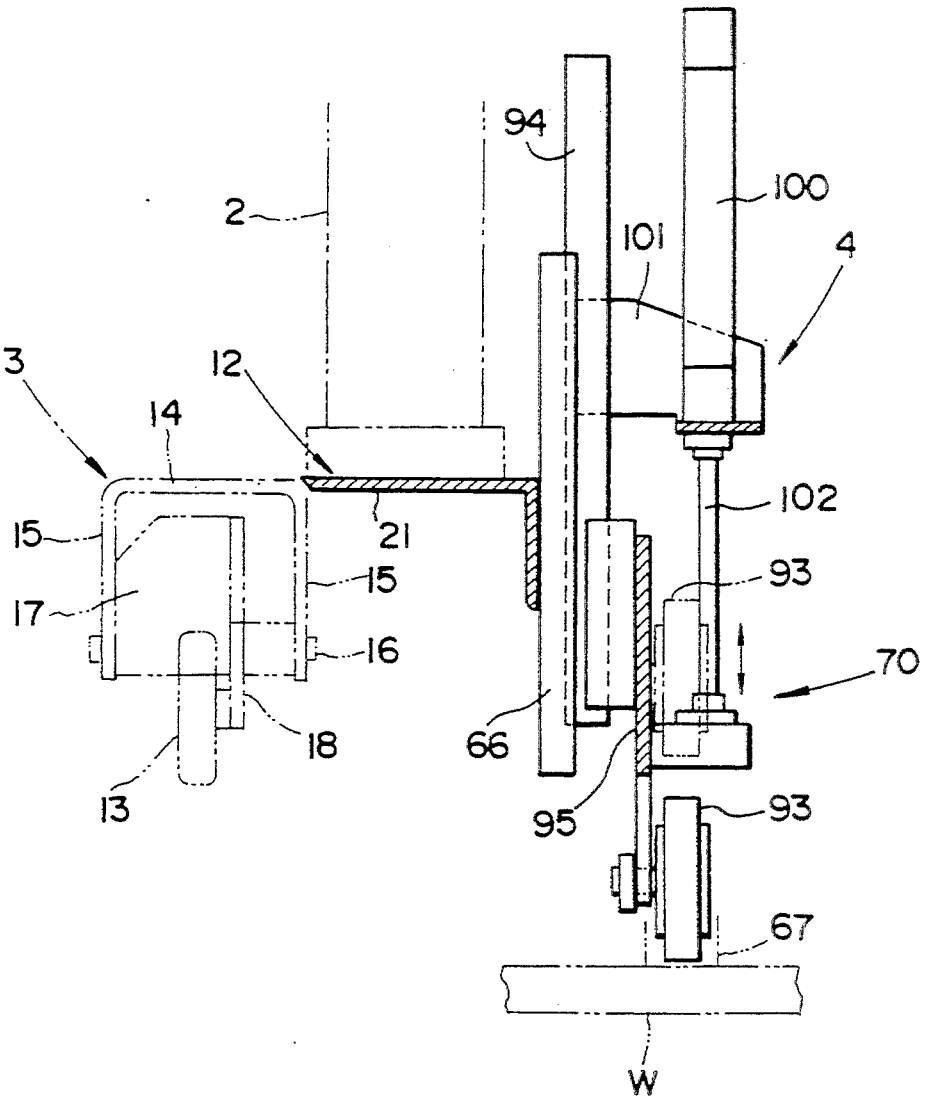
FIG. 7 is an enlarged cross-sectional view taken along line VII—VII of FIG. 2.

As shown in FIGS. 6 and 7, the presser 70 has a pressing roller 93 rotatably supported on the lower end of a central portion of the base plate 66. The central portion of the base plate 66 supports a vertical guide rail 94 and a vertically movable member 95 slidably engaging the guide rail 94 for vertical movement toward and away from the surface a of the glass panel W. The pressing roller 93 is rotatably supported on the lower end of the vertically movable member 95 for vertical movement therewith. As shown in FIG. 6, the web of wiping cloth 67 which is unwound from the reel 74 travels around a pair of guide pins 96, 97 mounted on the base plate 66, and then goes around a lower outer circumferential surface of the pressing roller 93. Thereafter, the web of wiping cloth 67 travels around a pair of guide pins 98, 99 mounted on the base plate 66 and reaches the clamp 69.

A cylinder 100 is vertically fixed to the central portion of the base plate 66 by a support 101. The cylinder 100 has a vertically movable piston rod 102 extending downwardly and having a lower distal end joined to the vertically movable member 95. The cylinder 100 serves to resiliently urge the pressing roller 93 against the surface a of the glass panel W when the surface a of the glass panel W is to be wiped. When the piston rod 102 is extended downwardly, the pressing roller 93 which is held against the web of wiping cloth 67 is moved downwardly toward the surface a of the glass panel W. The cylinder 100 also serves to lift and lower the pressing roller 93 upon switching between wiping and primer coating processes. As shown in FIG. 7, when the piston rod 102 is extended, the pressing roller 93 projects downwardly of the primer coating roller 13, i.e., toward the glass panel W, and when the piston rod 102 is contracted, the pressing roller 93 is retracted upwardly of the primer coating roller 13, i.e., away from the glass panel W, as indicated by the dotted lines in FIG. 7.

As illustrated in FIGS. 2 and 6, the presser 70 also has a tensioning mechanism 103 for tensioning the web of wiping cloth 67 between the reel 74 and the clamp 69.

The tensioning mechanism 103 has a biasing mechanism 104 for biasing the rotatable shaft 73 to rotate in a direction opposite to the direction in which the rotatable shaft 73 rotates to supply the web of wiping cloth 67. As shown in FIG. 2, the biasing mechanism 104 comprises an arm 105 extending radially outwardly from the second tubular member 79 rotatable with the frictional engagement member 80 and a coil spring 107 engaging the arm 105 and a pin 106 mounted on the base plate 66.

Under the bias of the coil spring 107, the rotatable shaft 73 of the reel 74 is normally urged to rotate in the direction opposite to the direction in which the rotatable shaft 73 rotates to supply the web of wiping cloth 67, through the frictional engagement member 80 which is held in frictional engagement with the rotatable shaft 73 through the friction plate 81.

When the web of wiping cloth 76 is pulled out, the rotatable shaft 73 rotates in the direction indicated by the arrow p in FIG. 6. The frictional engagement member 80 and the second tubular member 79 also rotate in the same direction as the rotatable shaft 73. At this time, the arm 105 also turns in the same direction as the second tubular member 79. After the arm 105 has turned a certain angular interval, the coil spring 107 between the arm 105 and the pin 106 is fully extended, stopping the arm 105, the second tubular member 79, and the frictional engagement member 80. As the web of wiping cloth 67 is further pulled out against the friction between the annular friction plate 81 and the frictional engagement member 80, the annular friction plate 81 and the frictional engagement member 80 slip with respect to each other. Consequently, the rotatable shaft 73 and the reel 74 are allowed to continuously rotate in the direction to pull out the web of wiping cloth 67. When the web of wiping cloth 67 is no longer pulled out, the rotatable shaft 73 and the reel 74 are normally urged by the coil spring 107 to turn in the direction, indicated by the arrow q in FIG. 6, opposite to the direction in which the rotatable shaft 73 rotates to supply the web of wiping cloth 67. If the web of wiping cloth 67 unwound from the reel 74 is loosened, it is wound back by the reel 74 to remove any slack from the web of wiping cloth 67. Therefore, the web of wiping cloth 67 unwound from the reel 74 remains under tension.

As shown in FIGS. 1 and 6, the wiping solution supply device 8 comprises a storage tank 108 for storing a wiping solution C, a fluid passage 111 extending from the storage tank 108 through a pump 109 to an on-off valve 110 fixedly mounted on the base plate 66, and a drop nozzle 114 connected to a distal end of a supply pipe 112 extending from the on-off valve 110 and supported by a support 113 on the vertically movable member 95 in front of the pressing roller 93. The wiping solution C is supplied by the pump 109 from the storage tank 108 through the fluid passage 111, the on-off valve 110, and the supply pipe 112 to the drop nozzle 114, from which the wiping solution C drops onto the glass panel W in front of the pressing roller 93. The fluid passage 111 may comprise a suitable fluid supply pipe.

Figure 10:
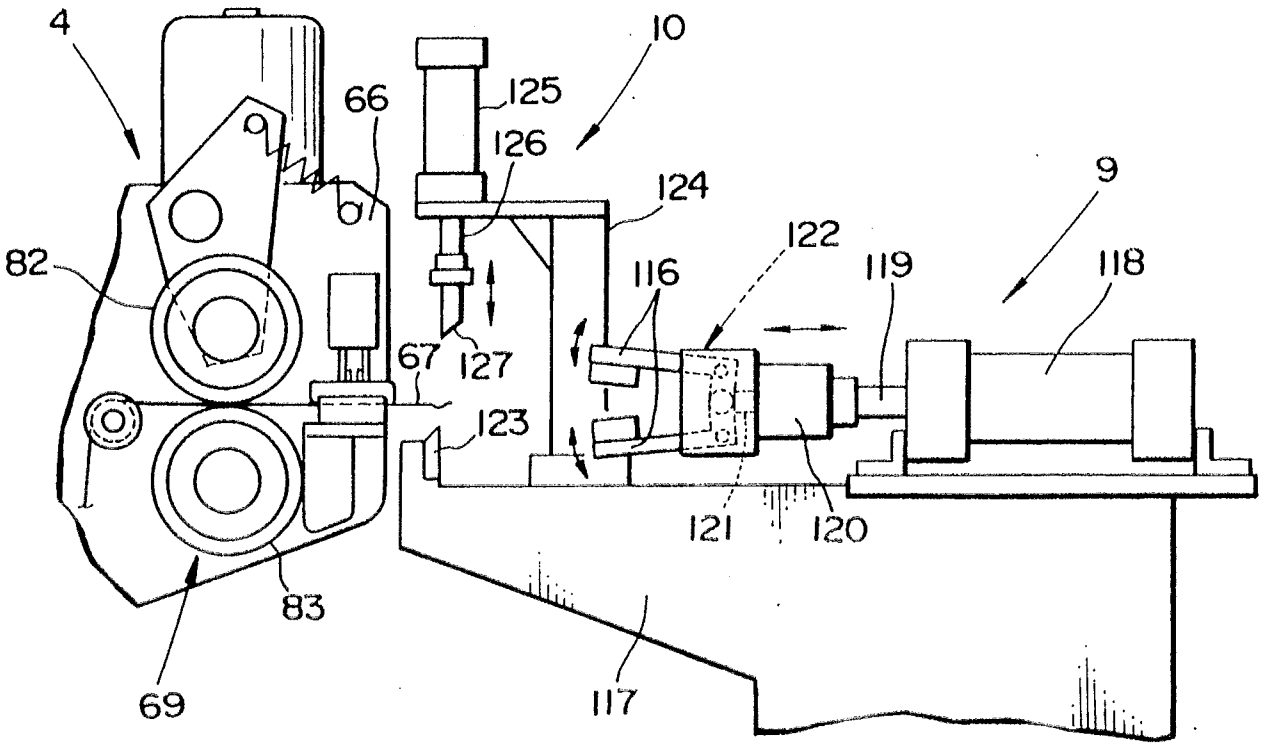
FIG. 10 is a side elevational view of devices for pulling and cutting a wiping material in the apparatus shown in FIG. 1.

In FIGS. 1 and 10, the pulling device 9 for pulling the web of wiping cloth 67 has a pair of gripper hands 116 movable toward and away from the leading end of the web of wiping cloth 67 that is clamped by the clamp 69 of the wiper 4 that has been moved to the standby station Sb by the arm 2 of the robot 1. The gripper hands 116 are coupled by a cylinder 120 to a piston rod 119 of a cylinder 118 that is fixedly mounted on a base 117 in the standby station Sb. When the piston rod 119 is extended or retracted, it moves the gripper hands 116 toward or away from the leading end of the web of wiping cloth 67. The gripper hands 116 are connected by a link 122 to a piston rod 121 of the cylinder 120. The gripper hands 116 are movable toward and away from each other when the piston rod 121 is retracted and extended.

With the wiper 4 in the standby station Sb, the gripper hands 116 are moved by the cylinder 118 toward the web of wiping cloth 67 clamped by the clamp 69, and then moved by the cylinder 120 toward each other, gripping the leading end of the web of wiping cloth 67. After having gripped the leading end of the web of wiping cloth 67, the gripper hands 116 are retracted by the cylinder 118, thereby pulling the web of wiping cloth 67 by a predetermined distance out of the clamp 69.

The cutting device 10 comprises a first cutter 123 fixedly mounted on the base 117 below the web of wiping cloth 67 pulled by the pulling device 9, and a second cutter 127 positioned above the first cutter 123 and coupled to a piston rod 126 of a cylinder 125 fixed to a support base 124 that is vertically supported on the base 117. The second cutter 127 is movable toward and away from the first cutter 123 by the piston rod 126 of the cylinder 125.

After the web of wiping cloth 67 has been pulled by the pulling device 9, the second cutter 127 is moved downwardly toward the first cutter 123 by the cylinder 125. When the second cutter 127 engages the first cutter 123, they coact with each other to cut off the web of wiping cloth 67 into a certain length of wiping cloth.

Operation of the primer applying and surface wiping apparatus according to the first embodiment of the present invention will be described below.

As shown in FIGS. 1 and 6, the surface a of the glass panel W to which the primer is to be applied is wiped before the primer is applied.

First, the primer applicator 3 and the wiper 4 are moved by the arm 2 to a position above the surface a of the glass panel in the working station Sa according to the data that the robot 1 has been taught. At this time, the pressing roller 93 of the wiper 4 presses the web of wiping cloth 67 trained around the lower circumferential surface thereof against the surface a of the glass panel W. At this time, as indicated by the solid lines in FIG. 7, the pressing roller 93 is resiliently moved with the vertically movable member 95 downwardly of the primer coating roller 13 by the cylinder 100, and the primer coating roller 13 is held out of contact with the glass panel W. In FIG. 6, the web of wiping cloth 67 pulled from the reel 74 is supplied around the guide pins 96, 97, the pressing roller 93, and the guide pins 98, 99, and gripped between the rollers 82, 83 of the clamp 69. The leading end of the web of wiping cloth 67 which projects from the rollers 82, 83 is held in position by the positioner 89. The rotatable shaft 73 of the reel 74 is biased by the coil spring 107 to turn in the direction opposite to the direction in which the shaft 73 rotates to supply the web of wiping cloth 67, i.e., in the direction to wind back the web of wiping cloth 67. Accordingly, the web of wiping cloth 67 is kept under tension between the reel 74 and the clamp 69.

Then, the arm 2 of the robot 1 is actuated to move the wiper 4 along a predetermined path, i.e., in the direction X in FIGS. 2 and 6 along the surface a of the glass panel W. Concurrent with this, the wiping solution C drops from the drop nozzle 114 onto the surface a of the glass panel W in front of the pressing roller 93 in the direction in which the pressing roller 93 progresses.

The pressing roller 93 and the web of wiping cloth 67 on its lower outer circumferential surface slide on the surface a of the glass panel W to which the wiping solution has been applied, thereby wiping dust, fingerprints, or oily films off the surface a of the glass panel W.

Since the pressing roller 93 is resiliently urged against the glass panel W by the cylinder 100, the web of wiping cloth 67 is reliably pressed against the surface a of the glass panel W, and hence the surface a is reliably wiped. Any slack in the web of wiping cloth 67 is removed by the biasing mechanism 104, so that the web of wiping cloth 67 is maintained under tension at all times. The web of wiping cloth 67 on the lower surface of the pressing roller 93 is thus reliably held in contact with the glass panel W, and the surface a is smoothly wiped.

The wiping process is finished when the pressing roller 93 moves fully round the peripheral edge of the glass panel W. After the glass panel W has been wiped, the pressing roller 93 is lifted by the cylinder 100 away from the glass panel W above the primer coating roller 13 as indicated by the dotted lines in FIG. 7.

Then, the arm 2 is actuated to move the primer applicator 3 and the wiper 4 laterally until the primer coating roller 13 is placed on the surface a of the glass panel W as shown in FIG. 3. At this time, the primer coating roller 13 is pressed against the surface a under the bias of the coil spring 20.

The arm 2 is actuated again to move the primer applicator 3 along a predetermined path, i.e., in the direction indicated by the arrow Y in FIGS. 2 and 3 along the surface a of the glass panel W. At the same time, the pump 25 of the primer supply device 6 is actuated to supply the primer A from the storage tank 24 through the fluid passage 27, the on-off valve 26, and the primer supply pipe 28 to the outer circumferential surface of the primer coating roller 13. Since the supplied primer A enters the numerous pores in the porous outer layer 23 of the primer coating roller 13, the primer A is well attached to the outer circumferential surface of the primer coating roller 13. When the primer coating roller 13 rolls on the surface a of the glass panel W, the primer A attached to the primer coating roller 13 is transferred and applied to the surface a, thus forming a primer coated layer b on the surface a. The primer coating roller 13 is swingable about the support shaft 16 in a direction substantially normal to the surface a of the glass panel W, and is urged against the surface a under the resiliency of the coil spring 20. Accordingly, the primer coating roller 13 is held in contact with the glass panel W through a uniform area as the primer coating roller 13 rolls on the glass panel W.

While the primer A is being thus applied to the surface a of the glass panel W, the controller 7 detects, from detected signals from the detectors 30 through 33, the rate at which the primer A is supplied to the primer coating roller 13, whether the primer coating roller 13 is in good contact with the glass panel W, whether the primer coating roller 13 is rotated when the primer A is applied to the glass panel W, and the coated layer b of the primer A applied to the glass panel W. The controller 7 thus determines whether the primer A is well applied to the glass panel W based on the signals supplied from the detectors 30 through 33. Specifically, if the rate at which the primer A is supplied to the primer coating roller 13, as indirectly detected by the pressure sensor 35, falls within a predetermined range, if no detected signal is received from the proximity switch 37, if the rotational speed of the primer coating roller 13 as detected by the rotation sensor 49 falls within a predetermined range, and also if the detected signal from the light-detecting element **44*b* of the optical detector 44 is higher than a predetermined level, then the controller 7 determines that the primer A is well applied to the glass panel W. Otherwise, the controller 7** determines that the primer A is not well applied to the glass panel W.

More specifically, when the primer coating roller 13 is properly supported on the surface a of the glass panel W, the detectable element 39 is positioned in confronting relationship to the proximity switch 37. At this time, the proximity switch 37 does not produce any signal. If the primer coating roller 13 is displaced off the glass panel W for some reason, allowing the swing plate 18 to swing as indicated by the dotted lines in FIG. 3, then the detectable element 39 moves away from the proximity switch 37. The proximity switch 37 now generates a signal which is applied to the controller 7.

In response to the signal from the proximity switch 37, the controller 7 determines that the primer coating roller 13 is not properly placed on the glass panel W and the primer A is not coated on the surface a of the glass panel W. Therefore, the controller 7 determines that the primer A is not well applied to the glass panel W.

When the primer coating roller 13 is properly supported on the glass panel W and pressed against the glass panel W under proper pressure, the primer coating roller 13 rolls on the glass panel W at a speed corresponding to the speed of the arm 2 of the robot 1. If the primer coating roller 13 fails to rotate smoothly for some reason, its rotational speed differs from the normal rotational speed. Therefore, if the rotational speed of the primer coating roller 12 as detected by the rotation sensor 40 does not fall within a predetermined range, then the controller 7 determines that the primer A is not well applied to the glass panel W because the primer coating roller 13 does not roll properly on the glass panel W, failing to apply the primer A well to the glass panel W.

The primer coating process is brought to an end when the primer coating roller 13 goes fully round the peripheral edge of the glass panel W. If the primer coating roller 13 rolls properly on the surface a of the glass panel W, then the rotation sensor 40 should produce a predetermined number of pulses when the primer coating process is finished. Therefore, the controller 7 counts pulses produced from the rotation sensor 40 until the primer coating roller 13 goes fully round the peripheral edge of the glass panel W, and determines that the primer A is not well applied to the glass panel W if the pulse count does not agree with a predetermined pulse count.

Even if the primer coating roller 13 rotates properly and is held in proper contact with the glass panel W, the primer A may not be uniformly applied to the glass panel W if the primer A is excessively or insufficiently supplied. The controller 7 determines that the primer A is not well applied to the glass panel W if the pressure difference (corresponding to the rate at which the primer A is supplied) as detected by the pressure sensor 35 when the on-off valve 26 is closed and opened falls outside of a predetermined range.

Generally, the primer A is relatively glossy immediately after it is applied to the glass panel W, and hence tends to reflect light applied thereto. Light which is applied to an area of the glass panel W to which the primer A is not applied is mostly diffused by the glass panel W. When the light beam La is applied from the light-emitting element **44*a* of the optical detector 44 to the surface a of the glass panel W after the primer coating roller 13 has rolled thereon, if the primer coated layer b is formed on the surface a, then a reflected light beam Lb is detected by the light-detecting element 44*b*, which applies a signal to the controller 7. If no primer coated layer b is formed on the surface a, or the primer coated layer b formed on the surface a is very thin, the light-detecting element 44*b* detects almost no reflected light beam, and hence does not produce a signal or produces a signal of very low level. The controller 7 determines that the primer A is not well applied to the glass panel W if the signal from the light-detecting element 44*b*** is lower than a predetermined level.

When the primer coating roller 13 is properly held against the glass panel W, the primer coating roller 13 rotates well, and the primer A is supplied to the primer coating roller 13 at a proper rate, the primer coating roller 13 is considered as being held in contact with the glass panel W through a uniform area under a uniform pressure, and the primer A is considered as being supplied uniformly to every portion of the area through which the primer coating roller 13 contacts the glass panel W. Consequently, the primer A may be judged as being applied uniformly at a proper rate to the surface a of the glass panel W. Since the primer A is apt to cake easily, the primer A may not be sufficiently applied to the glass panel W if the primer A supplied to the outer circumferential surface of the primer coating roller 13 cakes. When the controller 7 detects that the primer coated layer b is formed on the surface a after the primer coating roller 13 has rolled thereon, then the determination by the controller 7 that the primer A is applied uniformly at a proper rate to the surface a of the glass panel W is sufficiently reliable.

As described above, if the rate at which the primer A is supplied to the primer coating roller 13, as indirectly detected by the pressure sensor 35, falls within a predetermined range, if no detected signal is received from the proximity switch 37, if the rotational speed of the primer coating roller 13 as detected by the rotation sensor 49 falls within a predetermined range, and also if the detected signal from the light-detecting element 44*b* of the optical detector 44 is higher than a predetermined level, then the controller 7 determines that the primer A is well applied to the glass panel W.

Inasmuch as the primer A is applied to the glass panel W by the primer coating roller 13, the area through which the primer coating roller 13 contacts the glass panel 13 is uniformized, thus allowing the primer A to be applied relatively uniformly to the glass panel W. The outer layer 23 of the primer coating roller 13 is made of a soft porous material to which the primer A can uniformly be attached, and the primer coating roller 13 is urged against the surface a of the glass panel W. Therefore, the primer A can be coated uniformly more effectively to the glass panel W.

The controller 7 detects the rate at which the primer A is supplied to the primer coating roller 13, the condition in which the primer coating roller 13 contacts the glass panel W, the rotating condition of the primer coating roller 13, and whether the primer coated layer b is formed after the primer coating roller 13 has rolled, for thereby recognizing reliably and accurately the condition in which the primer A is applied to the glass panel W. The rate at which the primer A is supplied to the primer coating roller 13, the condition in which the primer coating roller 13 contacts the glass panel W, the rotating condition of the primer coating roller 13, and whether the primer coated layer b is formed after the primer coating roller 13 has rolled, can easily be detected using simple arrangements including the pressure sensor 35, the proximity switch 37, the rotation sensor 40, and the optical detector 44.

In the event that the controller 7 determines that the primer A is not well applied to the glass panel W, it displays the information to that effect on a display unit and produces a warning, prompting the operator to carry out a suitable repair procedure.

The primer coating process is ended when the primer coating roller 13 moves fully round the peripheral edge of the glass panel W. After the primer coating process, the arm 2 of the robot 1 is actuated to move the primer applicator 3 and the wiper 4 from the working station Sa to the standby station Sb (see FIG. 1). In the standby station Sb, the primer coating roller 13 is cleaned.

More specifically, as shown in FIG. 8, the covers 62 are opened by the cylinder 63, and the arm 2 is actuated to insert the primer applicator 3 downwardly into the cleaning solution tank 49. The primer coating roller 13 is pressed against the upper outer circumferential surface of the cleaning roller 50 while the axis of the primer coating roller 13 is inclined to the axis of the cleaning roller 50. Although not shown in FIG. 8, the wiper 4 on the arm 2 is also placed in the cleaning solution tank 49. However, it is possible to insert only the primer coating roller 13 into the cleaning solution tank 49.

Then, the cylinder 63 is actuated to close the covers 62, and the motor 57 is energized to rotate the cleaning roller 50.

Since the cleaning roller 50 and the primer coating roller 13 are held against each other with their axes inclined to each other, as shown in FIG. 9, the primer coating roller 13 is rubbed when it is rotated by the cleaning roller 50 under thrust forces applied to the primer coating roller 13. The soft porous outer circumferential layer 23 of the primer coating roller 13 is now pressed by the cleaning roller 50, squeezing out the primer A which has been entered in the pores of the layer 23. Because the lower outer circumferential surface of the cleaning roller 50 is immersed in the cleaning solution B in the cleaning solution tank 49, the cleaning solution B is applied to the lower outer circumferential surface of the cleaning roller 50. As the cleaning roller 50 rotates, the applied cleaning solution B is supplied to the region where the primer coating roller 13 and the cleaning roller 50 are pressed against each other. When the primer A is removed from the soft porous outer circumferential layer 23 in that region, the primer coating roller 13 is cleaned by the supplied cleaning solution B. As described above, the primer coating roller 13 is pressed against the cleaning roller 50 and is also rubbed by the cleaning roller 50. Consequently, the primer A applied to the outer circumferential surface of the primer coating roller 13 and trapped in the pores thereof is reliably removed from the primer coating roller 13.

If the cleaning solution tank 49 is running short of the cleaning solution B due to evaporation or the like, it is replenished by the auxiliary tank 54. The cleaning solution B is filtered when it is circulated between the cleaning solution tank 49 and the auxiliary tank 54.

As described above, after the primer A has been applied to the glass panel W, the remaining primer A applied to the soft porous layer 23 of the primer coating roller 13 is removed therefrom by the cleaning solution B in the standby station Sb. As a result, the primer A is prevented from caking or being solidified on the primer coating roller 13 when it applies the primer A to the glass panel W. Primer coating irregularities which would otherwise be caused by solidified primer masses on the primer coating roller 13 are therefore prevented in the primer applying process.

After the primer applying process, the arm 2 is actuated to move the wiper 4 back to the pulling device 9 and the cutting device 10.

Figure 11A:
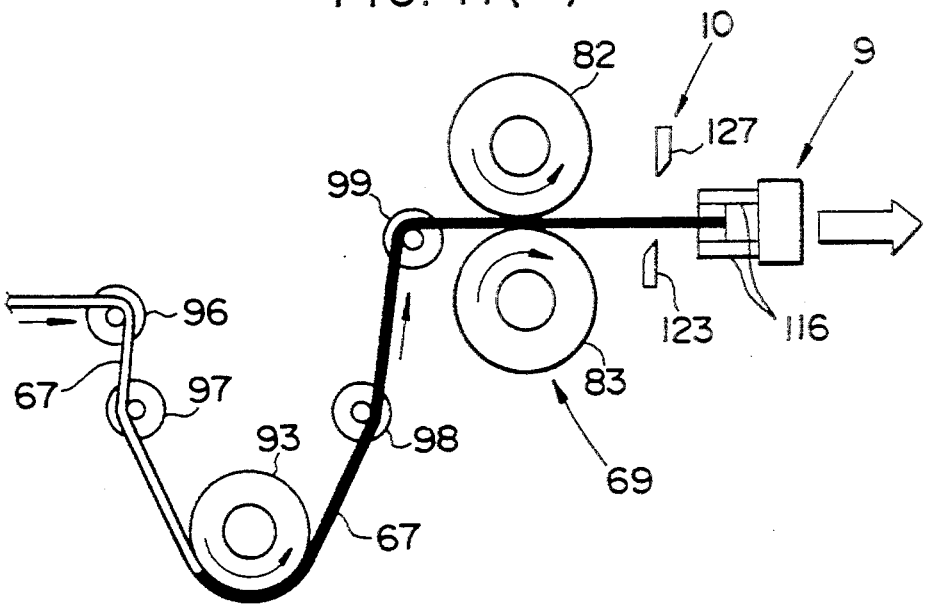
FIGS. 11(*a*) and 11(*b*) are schematic side elevational views showing the manner in which the devices for pulling and cutting a wiper operate.
Figure 11B:
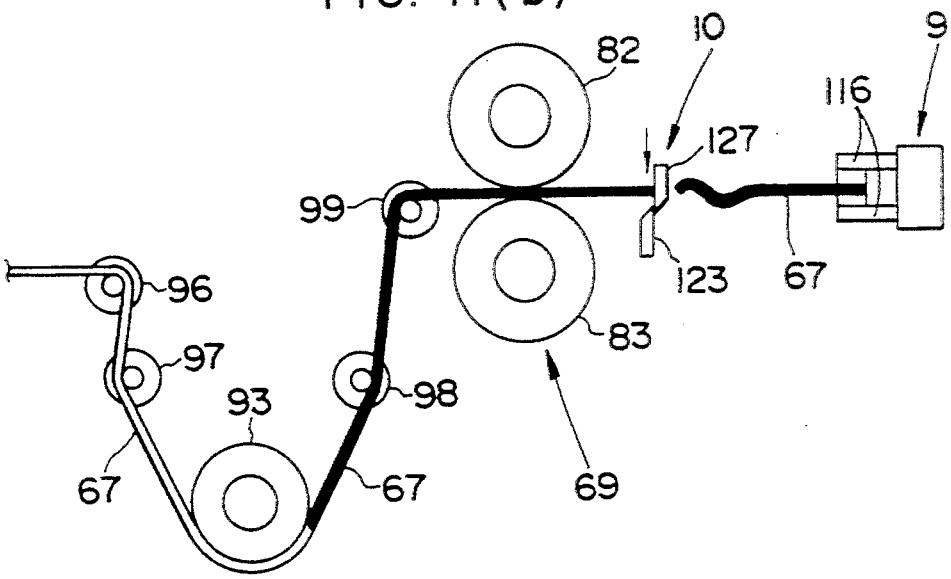

As shown in FIGS. 10 and 11(*a*), the gripper hands 116 of the pulling device 9 are moved by the cylinder 118 toward the leading end of the web of wiping cloth 67 which has projected out of the clamp 69 of the wiper 4. The gripper hands 116 are then moved by the cylinder 120 toward each other to grip the leading end of the web of wiping cloth 67. With the leading end of the web of wiping cloth 67 being gripped by the gripper hands 116, the gripper hands 116 are pulled back by the cylinder 118 to pull a used portion (indicated as a solid area in FIG. 11(*a*)) of the web of wiping cloth 67 out of the clamp 69.

The pressing roller 93 rotates to guide the web of wiping cloth 67 and to pull a new length of the web of wiping cloth 67 from the reel 74 as shown in FIG. 11(*b*). An unused portion of the web of wiping cloth 67 moves onto the lower circumferential surface of the pressing roller 93, and the used portion thereof leaves the lower circumferential surface of the pressing roller 93. The interval by which the pulling device 9 pulls the web of wiping cloth 67 is relatively small because the web of wiping cloth 67 may be pulled until the unused portion of the web of wiping cloth 67 reaches the lower circumferential surface of the pressing roller 93. Accordingly, the web of wiping cloth 67 can quickly be pulled from the reel 74. Since the unused portion of the web of wiping cloth 67 is contiguous to the used portion thereof which has left the lower circumferential surface of the pressing roller 93, the web of wiping cloth 67 can efficiently be consumed wastelessly.

Then, as shown in FIGS. 10 and 11(*b*), after the web of wiping cloth 67 has been pulled by the pulling device 9, the second cutter 127 of the cutting device 10 is lowered toward the first cutter 123 by the cylinder 125. The first and second cutters 123, 127 coact with each other to cut off the used portion of the web of wiping cloth 67 which has been pulled out of the clamp 69 by the pulling device 9. The severed portion of the web of wiping cloth 67 is thereafter discarded.

After the web of wiping cloth 67 has thus been cut off, the arm 2 is repeatedly actuated to apply the primer A to a new glass panel W.

In the illustrated embodiment, the web of wiping cloth 67 is pulled out and cut off after the primer coating roller 13 is cleaned. However, the primer coating roller 13 may be cleaned after the web of wiping cloth 67 has been pulled out and cut off. Furthermore, with the upper portion of the cleaning roller 50 projecting upwardly out of the cleaning solution tank 49, the primer coating roller 3 may be cleaned and the web of wiping cloth 67 may be pulled out and cut off at the same time.

A primer applying apparatus according to a second embodiment of the present invention will be described below with reference to FIGS. 12 through 14.

Those parts shown in FIGS. 12 through 14 which are identical to those shown in FIGS. 1 through 11(*a*) and 11(*b*) are denoted by identical reference characters, and will not be described in detail below.

Figure 12:
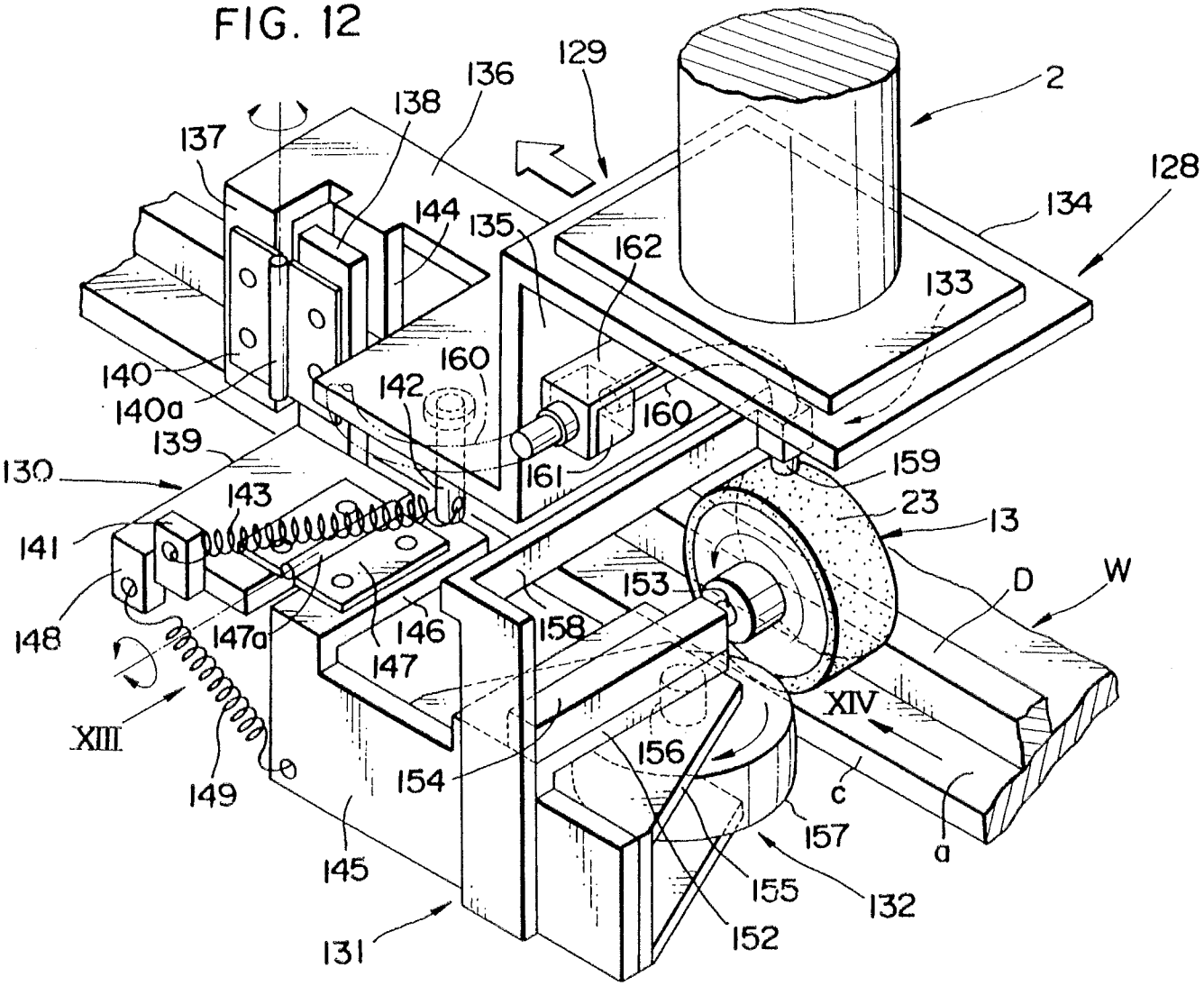
FIG. 12 is a fragmentary perspective view of a primer applying apparatus according to a second embodiment of the present invention.
Figure 13:
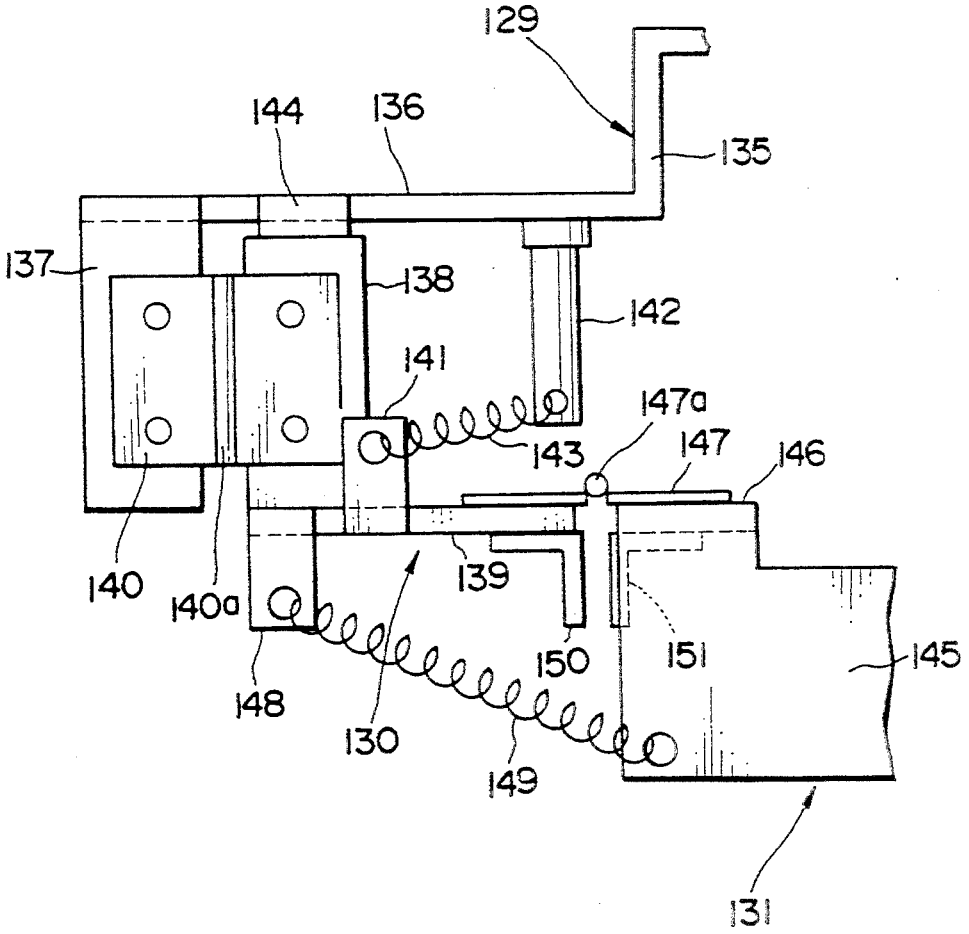
FIG. 13 is a side elevational view of the primer applying apparatus as viewed in the direction indicated by the arrow XIII in FIG. 12.

In FIG. 12, a primer applying apparatus is typically used to apply a primer to a glass panel W as with the first embodiment. The primer applying apparatus has a primer applicator 128 mounted on the distal end of an arm 2 of a robot (not shown). The primer applicator 128 basically comprises a base 129 attached to the distal end of the arm 2 for movement in unison therewith, a first movable member 130 swingably mounted on the base 129, a second movable member 131 swingably mounted on the first movable member 130, a primer coating roller 13 for applying a primer, a guide 132 for guiding the primer coating roller 13 to roll on a surface a along a peripheral edge c of the glass panel W, and a primer supply device 133 for supplying a primer to the primer coating roller 13.

The glass panel W is held substantially horizontally in a working station, and the surface a of the glass panel W to which the primer is to be applied faces upwardly. The glass panel W is kept in a predetermined positional relationship to the robot having the arm 2. A rubber dam D is attached to the upper surface of the glass panel W, the rubber dam D extending along and spaced from the peripheral edge c of the glass panel W. The surface a to which the primer will be applied lies between the rubber dam D and the peripheral edge c.

When the primer is applied to the glass panel W, the arm 2 is positioned substantially above the surface a of the glass panel W, and moved over the surface a along a predetermined path which the robot has been trained to follow.

The base 129 is of a bent shape and includes an upper horizontal base plate 134 fixed to the distal end of the arm 2, a vertical base plate 135 extending vertically downwardly from an end of the upper horizontal base plate 134, and a lower horizontal base plate 136 extending from a lower end of the vertical base plate 135 in a direction away from the upper horizontal base plate 134. The base 129 is thus movable in unison with the arm 2 through the upper horizontal base plate 134.

When the primer is applied to the glass panel W, the upper and lower horizontal base plates 134, 136 extend substantially in the longitudinal direction of and are positioned substantially upwardly of the surface a of the glass panel W.

The first movable member 130 is mainly composed of a swingable vertical attachment plate 138 disposed laterally of a fixed vertical attachment plate 137 extending vertically from a side edge of the distal end of the lower horizontal base plate 134, and a horizontal base plate 139 extending from the lower end of the swingable vertical attachment plate 138 transversely of the base 129. The swingable vertical attachment plate 138 and the horizontal base plate 139 are members of a bent plate.

The swingable vertical attachment plate 138 is coupled to the fixed vertical attachment plate 137 through a hinge 140. Therefore, the first movable member 130 is swingable about the axis of a vertical hinge pin 140*a* of the hinge 140.

A joint plate 141 is vertically mounted on the distal end of the horizontal base plate 139, and a joint rod 142 extends downwardly from the lower horizontal base plate 134. The first movable member 130 is normally urged to turn toward the base 129 about the hinge pin 140*a* by a spring 143 which is connected between the joint plate 141 and the joint rod 142. The swinging movement of the first movable member 130 under the bias of the spring 143 is limited when the swingable vertical attachment plate 138 abuts against a stopper plate 144 extending downwardly from a side of the lower horizontal base plate 134 in confronting relationship to the swingable vertical attachment plate 138.

When the primer is applied to the glass panel W, the horizontal base plate 139 extends substantially parallel to and from a position above the surface a of the glass panel W. In this attitude, the horizontal base plate 139 is angularly movable about the hinge pin 140*a* substantially along the surface a.

The second movable member 131 is mainly composed of a vertical base plate 145 disposed laterally of the distal end of the horizontal base plate 139 and extending vertically parallel to the swingable vertical attachment plate 138, and a horizontal base plate 146 extending from the upper end of the vertical base plate 145 near the first movable member 130 along the horizontal base plate 139. The vertical base plate 145 and the horizontal base plate 146 are members of a bent plate.

The horizontal base plate 146 is angularly movably coupled to the horizontal base plate 139 by a hinge 147, so that the second movable member 131 is angularly movable about the axis of a horizontal hinge pin 147*a* of the hinge 147.

The second movable member 131 is normally urged to turn downwardly about the hinge pin 147*a* by a spring 149 which is connected between the lower end of the vertical base plate 145 near the first movable member 130 and a joint plate 148 extending downwardly from the distal end of the horizontal base plate 139. As shown in FIG. 13, confronting stopper plates 150, 151 which extend vertically downwardly are mounted respectively on lower surfaces of the horizontal base plates 139, 146. The angular movement of the second movable member 131 under the bias of the spring 149 is limited when the stopper plate 151 engages the stopper plate 150.

When the primer is applied to the glass panel W, the horizontal base plate 146 extends substantially parallel to and from a position above the surface a of the glass panel W. In this attitude, the horizontal base plate 146 is angularly movable about the hinge pin 147*a* substantially perpendicularly to the surface a.

As shown in FIG. 12, a horizontal support plate 152 extends from the upper end of the vertical base plate 145 toward a region below the upper horizontal base plate 134. A support shaft 153 is fixedly mounted on the horizontal support plate 152 by a support 154, the support shaft 153 extending in the longitudinal direction of the horizontal support plate 152, i.e., parallel to the hinge pin 147*a*.

Figure 14:
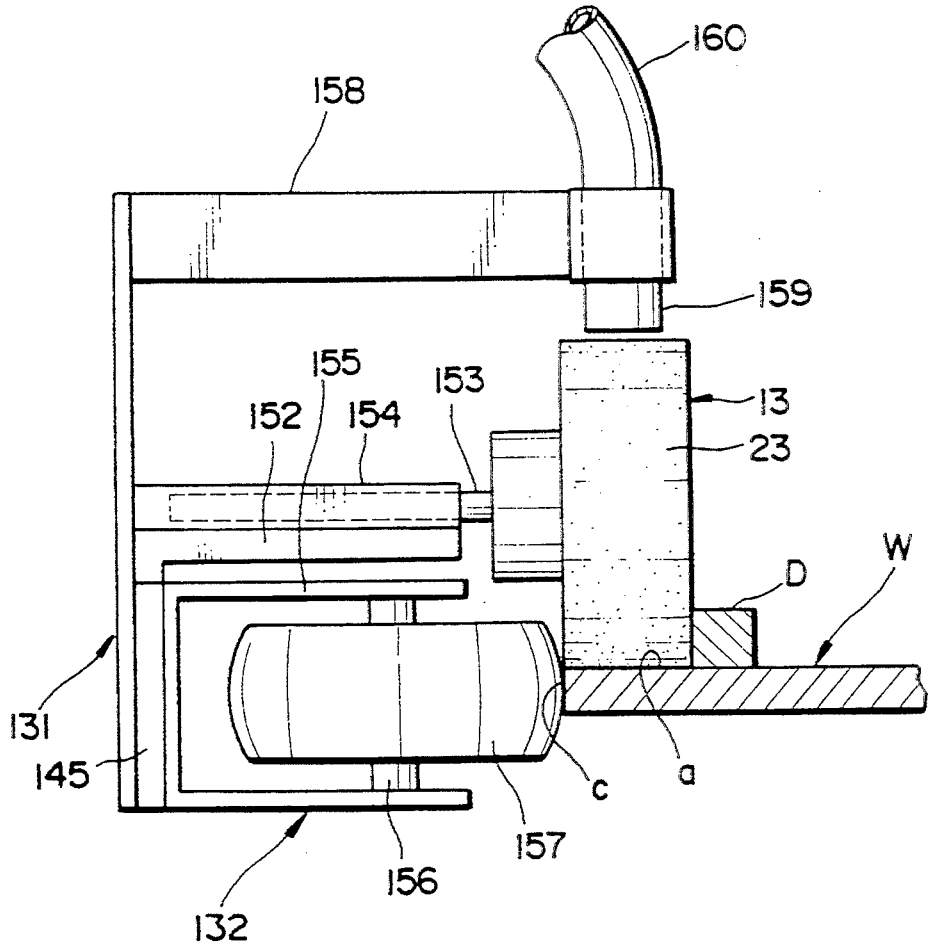
FIG. 14 is a side elevational view of the primer applying apparatus as viewed in the direction indicated by the arrow XIV in FIG. 12.

In FIGS. 12 and 14, the primer coating roller 13 is rotatably supported on a distal end of the support shaft 153 which projects beyond the horizontal support plate 152. The primer coating roller 13 has an outer circumferential layer 23 which may be made of a soft porous resin material such as cellular ethylene propylene rubber.

The guide 132 comprises a guide roller 157 rotatably supported on a vertical support shaft 156 which is supported by a bracket 155 fixed to the vertical base plate 145 below the horizontal support plate 152. The guide roller 157 is held in rolling contact with the peripheral edge c of the glass panel W while the primer coating roller 13 is in contact with the surface a of the glass panel W.

When the guide roller 147 rolls in contact with the peripheral edge c of the glass panel W, it guides the primer coating roller 13 to roll on the surface a along the peripheral edge c.

As shown in FIG. 12, the primer supply device 133 has a supply nozzle 159 directed downwardly to the upper surface of the primer coating roller 13 and mounted on an attachment plate 158 extending from the vertical base plate 145 to a position above the primer coating roller 13. When the primer is supplied from a primer supply (not shown) to the supply nozzle 159 through a supply pipe 160, the primer can be supplied from the supply nozzle 159 onto the outer circumferential surface of the primer coating roller 13.

The supply pipe 160 has a flow rate control valve 161 fixed to an attachment plate 162 extending horizontally from the upper horizontal base plate 134.

Operation of the primer applying apparatus according to the second embodiment will be described below with reference to FIG. 12.

Before the primer is applied to the glass panel W, the arm 2 is moved, together with the base 129, to a position above the surface a of the glass panel W according to the data that the robot has been taught. The primer coating roller 13 is brought into contact with the surface a of the glass panel W, and the guide roller 157 is held in reliable contact with the peripheral edge c of the glass panel W.

Since the second movable member 131 which supports the primer coating roller 13 and the guide roller 157 is supported on the first movable member 130 for angular movement about the hinge pin 147*a* and normally urged downwardly by the spring 149, the primer coating roller 13 is kept in contact with the surface a of the glass panel W under a suitable pressure.

In addition, since the first movable member 130 which supports the second movable member 131 is supported on the base 129 for angular movement about the hinge pin 140*a* and normally urged toward the base 129 substantially parallel to the surface a of the glass panel W by the spring 149, i.e., in a direction to move the second movable member 131 closely to the peripheral edge c of the glass panel W, the guide roller 157 is reliably kept in contact with the peripheral edge c of the glass panel W under a suitable pressure.

The arm 2 is then moved, together with the base 129, along the surface a of the glass plate W along a path that the robot has been taught. At the same time, the primer is supplied from the supply nozzle 159 of the primer supply device 133 to the outer circumferential surface of the primer coating roller 13.

When the arm 2 is moved with the base 129, the primer coating roller 13 rolls on the surface a of the glass panel W while being guided along the peripheral edge c thereof by the guide roller 157. The primer supplied to the outer circumferential surface of the primer coating roller 13 is now coated on the surface a of the glass panel W.

Even if the path along which the arm 2 and the base 129 move is shifted out of alignment with the configuration of the surface a of the glass panel W due to a positional error between the glass panel W and the robot or a dimensional error of the glass panel W, the primer coating roller 13 rolls in pressed contact with the surface a of the glass panel W at all times to reliably apply the primer to the surface a because the primer coating roller 13 is angularly movably supported on the second movable member 131 that is supported on the base 129 through the first movable member 130 for angular movement about the hinge pin 147*a*, and also is normally urged downwardly by the spring 129.

The guide roller 157 for guiding the primer coating roller 13 along the peripheral surface c of the glass panel W is supported through the second movable member 131 on the first movable member 130 that is swingably supported on the base 129 movable with the arm 2 for swinging movement about the hinge 140*a*, and is normally urged toward the peripheral edge c of the glass panel W by the spring 143 which biases the first movable member 130. Therefore, the guide roller 157 rolls in contact with the peripheral edge c of the glass panel W at all times. The primer coating roller 13 is caused by the guide roller 157 to reliably roll on the surface a of the glass panel W along the peripheral surface c. Thus, the primer can reliably be applied to the surface a.

The outer circumferential layer 23 of the primer coating roller 13 is made of a soft porous material as with the first embodiment. The primer supplied to the outer circumferential surface of the primer coating roller 13 is thus uniformly attached to the layer 23. Accordingly, as the primer coating roller 13 rolls on the surface a of the glass panel W, the primer is uniformly applied to the surface a along substantially the full length of the surface a.

In the second embodiment, the primer can be coated uniformly to the surface a of the glass panel W along the peripheral surface c thereof even if the glass panel W is not accurately positioned or suffers a dimensional error.

While only the primer applicator 128 is mounted on the distal end of the arm 2 in the second embodiment, a wiper for wiping the glass panel W may also be mounted on the distal end of the arm 2. The primer applying apparatus according to the second embodiment may also have a device for cleaning the primer coating roller 13 and an arrangement for determining whether the primer is well applied to the glass panel W.

A surface wiping apparatus according to a third embodiment of the present invention will be described below with reference to FIGS. 15 and 16.

Those parts shown in FIGS. 15 and 16 which are identical to those shown in FIGS. 1 through 11(*a*) and 11(*b*) are denoted by identical reference characters, and will not be described in detail below.

According to the third embodiment, the surface wiping apparatus wipes dust, fingerprints, or oily films off a surface a of a glass panel W before a primer is applied to the glass panel W. The surface wiping apparatus has a wiper 163 mounted on the distal end of an arm 2 of a robot (not shown). As shown in FIGS. 15 and 16, the wiper 163 is primarily composed of a base 164 fixed to the distal end of the arm 2, a holder 165 for holding a coiled elongate web of wiping cloth 67, a clamp 166 for clamping the leading end of the web of wiping cloth 67 unwound from the holder 165, a presser 167 for pressing the web of wiping cloth 67 against the surface a of the glass panel W while tensioning the web of wiping cloth 67 between the holder 165 and the clamp 166, and a wiping solution supply device 168 for supplying a wiping solution to the surface a of the glass panel W.

As with the first embodiment, the surface wiping apparatus also has a pulling device 169 for pulling out the web of wiping cloth 67 from the clamp 166, and a cutting device 170 for cutting off the web of wiping cloth 67 that has been pulled out of the clamp 166.

Figure 15:
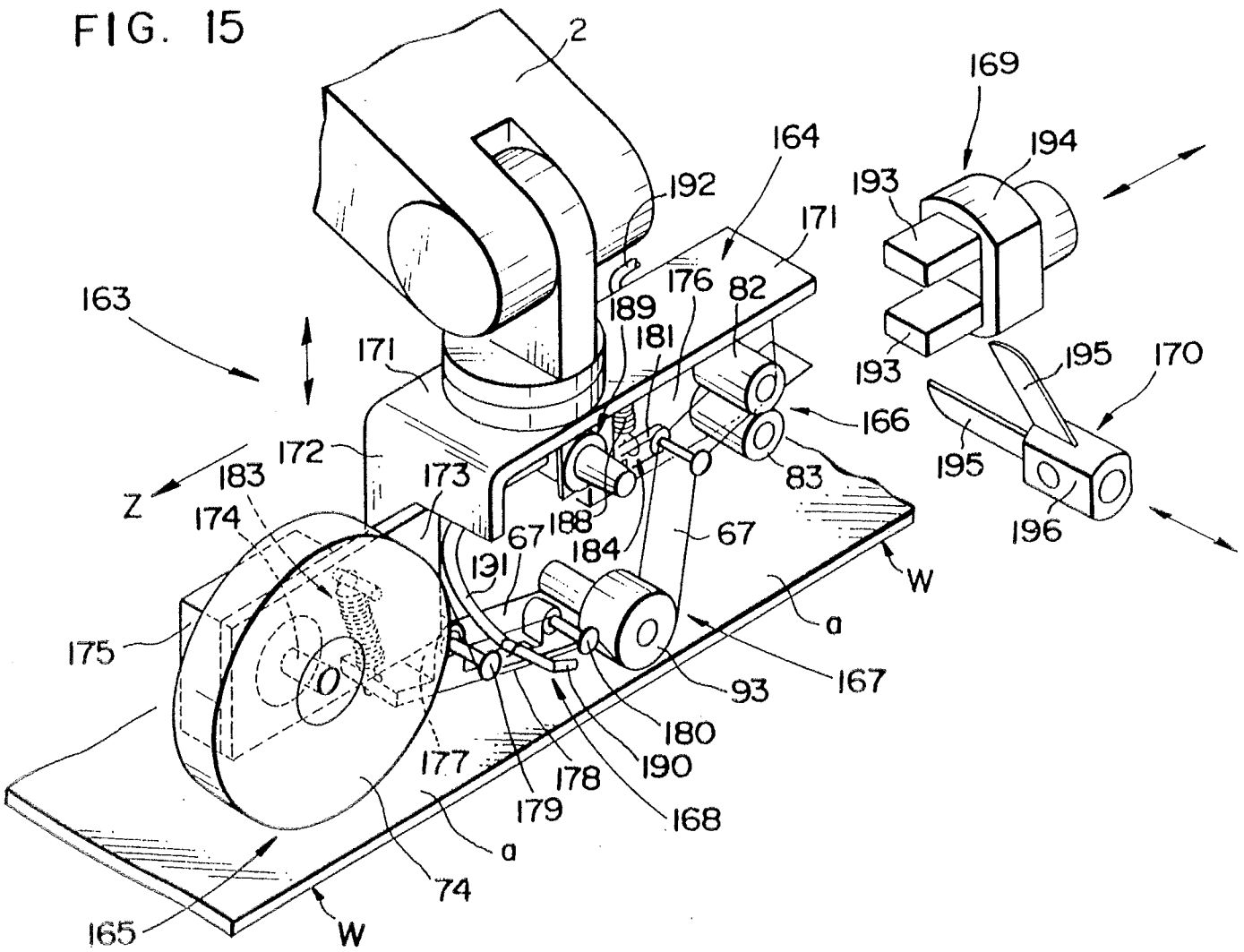
FIG. 15 is a fragmentary perspective view of a surface wiping apparatus according to a third embodiment of the present invention.
Figure 16:
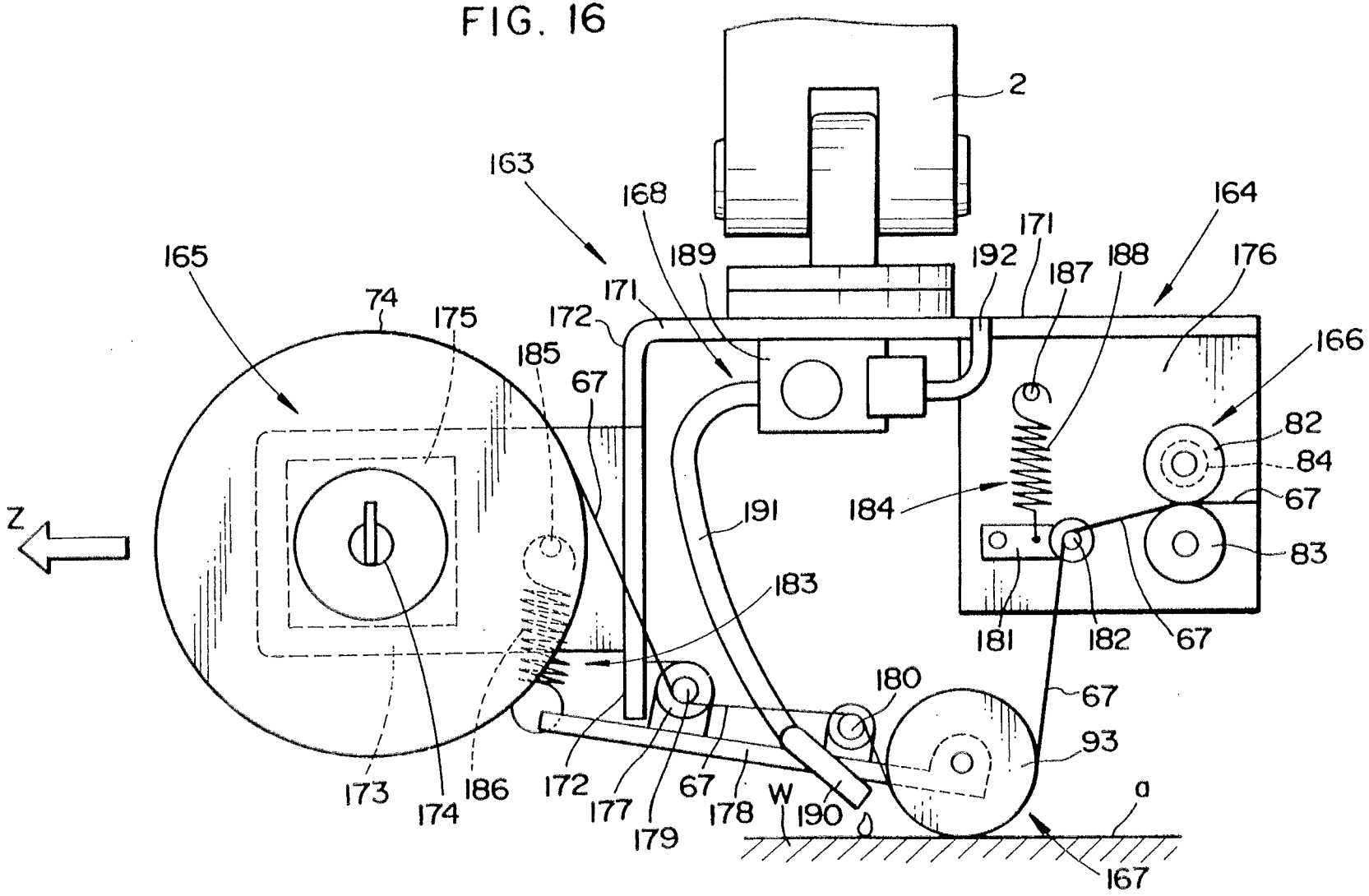
FIG. 16 is a side elevational view of the surface wiping apparatus shown in FIG. 15.

As shown in FIGS. 15 and 16, the base 164 is in the form of a bent plate and includes a horizontal base plate 171 fixed to the distal end of the arm 2, and a vertical base plate 172 extending downwardly from an end of the horizontal base plate 171.

The holder 165 has a reel 74 rotatably supported by a rotatable shaft 174 on a first support plate 173 joined to and extending from a side edge of the vertical base plate 172. The web of wiping cloth 67 is wound and held on the reel 74.

A locking device 175 for locking the reel 74 against rotation is mounted on the back of the first support plate 173, the locking device 175 having an electromagnetic brake (not shown) coupled to the rotatable shaft 174. The locking device 175 unlocks the reel 74 for rotation only when the web of wiping cloth 67 is to be pulled out, and locks the reel 74 against rotation otherwise.

The clamp 166 comprises vertically confronting first and second rollers 82, 83 rotatably mounted on a second support plate 176 extending downwardly from the horizontal base plate 171. The leading end of the web of wiping cloth 67 is gripped and clamped between the first and second rollers 82, 83. The first roller 82 has a built-in one-way clutch 84 (see FIG. 16) for rotating the first roller 82 only in the direction in which the web of wiping cloth 67 is pulled out.

The presser 167 has a pressing roller 93 disposed below the horizontal base plate 171. Specifically, the pressing roller 93 is rotatably supported on the distal end of swing plate 178 that extends rearwardly (to the right in FIG. 16) and is vertically swingably supported by a hinge 177 on a lower edge of the vertical base plate 172. The pressing roller 93 is vertically swingable with the swing plate 178. The web of wiping cloth 67 unwound from the reel 74 travels around a guide pin 179 coaxially mounted in the hinge 177 and a guide pin 180 fixed to the swing plate 178 near the pressing roller 93. Then, the web of wiping cloth 67 travels around a lower circumferential surface of the pressing roller 93 and a guide pin 182 mounted on the distal end of a swing arm 181 vertically pivotally attached to the second support plate 176, and reaches the clamp 166.

In FIG. 16, the presser 167 has an urging device 183 for normally urging the pressing roller 93 downwardly against the glass panel W, and another urging device 184 for urging the web of wiping cloth 67 to tension it between the reel 74 and the clamp 166.

The urging device 183 comprises a coil spring 186 coupled between the other end of the swing plate 178 remote from the pressing roller 93 and a pin 185 mounted on the first support plate 173, for normally urging the swing plate 178 in a direction to move the pressing roller 93 downwardly.

The urging device 184 comprises a coil spring 188 coupled between a pin 187 mounted on the second support plate 176 and a substantially central portion of the swing arm 181 which is positioned below the pin 187, for normally urging upwardly the portion of the web of wiping cloth 67 which is trained around the guide pin 182.

With the reel 74 being locked against rotation by the locking device 175, the web of wiping cloth 67 which is trained around the pressing roller 93 and the guide pins 179, 180, 182 between the reel 74 and the clamp 166 is urged downwardly at the pressing roller 93 and urged upwardly at the guide pin 182. Therefore, the web of wiping cloth 67 is kept under tension between the reel 74 and the clamp 166.

In FIG. 16, the wiping solution supply device 168 has an on-off valve 189 fixed to the lower surface of the horizontal base plate 171, a drop nozzle 190 secured to the swing plate 178 between the guide pins 179, 180, a supply pipe 191 interconnecting the drop nozzle 190 and the on-off valve 189, and a supply pipe 192 extending from the on-off valve 189 and connected to a wiping solution supply (not shown) outside of the wiper 163. The wiping solution is supplied from the wiping solution supply through the supply pipe 192, the on-off valve 189, and the supply pipe 191 to the drop nozzle 190, from which the wiping solution drops onto the surface a of the glass panel W in front of the pressing roller 93.

In FIG. 15, the pulling device 169 has a pair of gripper hands 193 for gripping the web of wiping cloth 67, and an actuator 194 for moving the gripper hands 193 toward and away from each other. The actuator 194 may comprise a cylinder or the like for causing a link to move the gripper hands 193. The pulling device 169 is disposed in a standby station for the arm 2. The pulling device 169 also has a mechanism (not shown) for moving the gripper hands 193 and the actuator 194 toward and away from the web of wiping cloth 67 that has projected from the clamp 166 of the wiper 163 which has been moved with the arm 2 to the standby station.

When the arm 2 is moved with the wiper 163 to the standby station, the pulling device 169 moves the gripper hands 193 toward the leading end of the web of wiping cloth 67 clamped by the clamp 166, and enables the gripper hands 193 to grip the leading end of the web of wiping cloth 67. Then, the pulling device 169 retracts the gripper hands 193 to pull out the web of wiping cloth 67.

The cutting device 170 serves to cut off the web of wiping cloth 67 pulled by the pulling device 169 in the standby station. The cutting device 170 comprises scissors-like cutters 195 and an actuator 196 for moving the cutters 195 toward and away from each other to cut the web of wiping cloth 67. The actuator 196 is basically the same as the actuator 194 which moves the gripper hands 193. The cutting device 170 also has a mechanism (not shown) for moving the cutters 195 and the actuator 196 toward and away from the web of wiping cloth 67 that has been pulled by the pulling device 169. The cutting device 170 moves the cutters 195 toward the web of wiping cloth 67 that has been pulled by the pulling device 169 in the standby station, and causes the cutters 195 to cut off the web of wiping cloth 67.

The surface wiping apparatus according to the third embodiment operates as follows:

To wipe the surface a of the glass panel W, the arm 2 is actuated to move the wiper 163 to a position above the surface a of the glass panel W, and the pressing roller 93 presses the web of wiping cloth 67 therebeneath against the surface a.

Inasmuch as the pressing roller 93 is mounted on the swing plate 178 and urged downwardly, the web of wiping cloth 67 is reliably pressed against the surface a of the glass panel W. At this time, the locking device 175 locks the reel 74 against rotation. If the web of wiping cloth 67 is loosened between the reel 74 and the clamp 166, the guide pin 182 is moved upwardly by the spring 188 to remove the slack from the web of wiping cloth 67. Therefore, the web of wiping cloth 67 is maintained under tension.

The wiping solution is now supplied from the drop nozzle 190 onto the surface a of the glass panel W. At the same time, the arm 2 is actuated to move the wiper 163 in the direction indicated by the arrow Z. The web of wiping cloth 67 beneath the pressing roller 93 now moves on and along the surface a while being kept under tension.

The web of wiping cloth 67 slides on the surface a to which the wiping solution has been applied, thereby wiping dust, fingerprints, or oily films off the surface a.

As described above, the pressing roller 93 is urged against the surface a of the glass panel W, and the web of wiping cloth 67 beneath the pressing roller 93 is kept under tension. Therefore, the surface a can reliably be wiped by the web of wiping cloth 67. In the case where a rubber dam (not shown) is mounted on the glass panel W inwardly of the surface a, when the pressing roller 93 contacts the rubber dam, the swing plate 178 swings to shift the pressing roller 93 out of interference with the rubber dam. The rubber dam is thus prevented from being damaged by the pressing roller 93.

After the surface a of the glass panel W has been wiped, the arm 2 is actuated to move the wiper 163 into the standby station. In the standby station, the used portion of the web of wiping cloth 67 is pulled out of the clamp 166 by the pulling device 169, and then cut off by the cutting device 170.

The web of wiping cloth 67 may be pulled by a relatively small interval until an unused portion thereof reaches the pressing roller 93. Accordingly, the web of wiping cloth 67 can quickly be pulled out by the pulling device 169. Since the unused portion of the web of wiping cloth 67 which is contiguous to the used portion thereof is used to wipe a new glass panel, the web of wiping cloth 67 can efficiently be consumed wastelessly.

The surface wiping apparatus according to the third embodiment may also have a primer applicator as with the first embodiment.

Although certain preferred embodiments of the present invention have been shown and described in detail, it should be understood that various changes and modifications may be made therein without departing from the scope of the appended claims.

What is claimed is:

1. An apparatus for applying a primer to a surface of a workpiece in a working station, comprising:

a primer applicator movable along the surface of the workpiece, said primer applicator having a primer coating roller rotatably supported thereon, said primer coating roller having an outer circumferential layer of soft resin;

moving means for moving said primer applicator along the surface of the workpiece in rolling contact therewith to apply the primer to the surface of the workpiece;

primer supply means for supplying the primer to said outer circumferential layer of the primer coating roller simultaneously as the primer coating roller rolls on the surface of the workpiece; and detecting means for detecting that said primer has been uniformly applied from said primer coating roller to the surface of said workpiece, said detecting means comprising first detecting means for detecting a rate at which the primer is supplied from said primer supply means to said primer coating roller when said primer coating roller rolls on the surface of the workpiece, second detecting means for detecting a condition in which said primer coating roller contacts the surface of the workpiece when said primer coating roller rolls on the surface of the workpiece, third detecting means for detecting a condition in which said primer coating roller rotates when said primer coating roller rolls on the surface of the workpiece, fourth detecting means for detecting whether a primer coated layer is formed on the surface of the workpiece after said primer coating roller has rolled on the surface of the workpiece, and processing means for determining application of the primer to the surface of the workpiece based on detected signals from said first through fourth detecting means.

2. The apparatus according to claim 1, wherein said moving means comprises a robot having an arm with said primer applicator mounted on a distal end thereof, said robot moving said primer applicator along a predetermined path along the surface of the workpiece when the primer is applied to the surface of the workpiece.

3. The apparatus according to claim 1, wherein said primer coating roller is supported on said primer applicator for movement substantially perpendicular to the surface of the workpiece, said primer applicator having urging means for urging said primer coating roller toward the surface of the workpiece.

4. The apparatus according to claim 1, further comprising guide means for guiding said primer coating roller to roll on the surface of the workpiece along a peripheral edge of the workpiece.

5. The apparatus according to claim 4, wherein said primer applicator comprises a frame movable in a direction along the surface of the workpiece by said moving means, said guide means comprising a first movable member mounted on said frame for movement substantially perpendicular to said direction and substantially parallel to the surface of the workpiece, a second movable member mounted on said first movable member for movement substantially perpendicular to the surface of the workpiece, said primer coating roller being rotatably mounted on said second movable member, a guide mounted on said second movable member for moving in contact with and along the peripheral edge of the workpiece when said frame moves along the surface of the workpiece, first urging means for urging said first movable member to press said guide against the peripheral edge of the workpiece, and second urging means for urging said second movable member to press said primer coating roller against the surface of the workpiece.

6. The apparatus according to claim 5, wherein said guide comprises a guide roller rotatably mounted on said movable member for rolling movement in contact with and along the peripheral edge of the workpiece when said frame moves along the surface of the workpiece.

7. The apparatus according to claim 1, wherein said primer coating roller is supported on said primer applicator for movement substantially perpendicular to the surface of the workpiece, said primer applicator having urging means for urging said primer coating roller toward the surface of the workpiece, said second detecting means comprising means for detecting the position of said primer coating roller with respect to said primer applicator substantially perpendicularly to the surface of the workpiece to thereby detect the condition in which said primer coating roller contacts the surface of the workpiece.

8. The apparatus according to claim 1, wherein said third detecting means comprises means for detecting a rotational speed of said primer coating roller to thereby detect the condition in which said primer coating roller rotates.

9. The apparatus according to claim 1, wherein said fourth detecting means comprises optical detecting means movably mounted on said primer applicator behind said primer coating roller for movement therewith, for applying light to the surface of the workpiece after said primer coating roller has rolled thereon and for detecting whether light is reflected from the surface of the workpiece thereby to detect whether a primer coated layer is formed on the surface of the workpiece.

10. The apparatus according to claim 1, wherein said moving means comprises means for moving said primer applicator from said working station to a standby station after the primer has been applied to the surface of the workpiece in said working station, said primer applicator having cleaning means for removing the primer which remains attached to said primer coating roller when said primer applicator has been moved to said standby station.

11. The apparatus according to claim 10, wherein said cleaning means comprises a cleaning roller rotatably mounted in a position in which the outer circumferential layer of said primer coating roller can be pressed against said cleaning roller by said moving means when said primer applicator has been moved to said standby station, actuating means for rotating said cleaning roller when said primer coating roller is pressed against said cleaning roller, and cleaning solution supply means for supplying a cleaning solution to a region where said primer coating roller is pressed against said cleaning roller when said cleaning roller is rotated by said actuating means.

12. The apparatus according to claim 11, wherein said cleaning solution supply means comprises a cleaning solution tank for storing the cleaning solution, said cleaning roller having an outer circumferential surface immersed in the cleaning solution stored in said cleaning solution tank, whereby when said cleaning roller is rotated by said actuating means, the cleaning solution in said cleaning solution tank is supplied to said region.

13. The apparatus according to claim 11, wherein said cleaning roller is disposed in said position such that said cleaning roller has an axis inclined relative to an axis of said primer coating roller in said standby station.

14. The apparatus according to claim 1, further comprising wiping means for wiping the surface of the workpiece in said working station before the primer is applied to the surface of the workpiece, said wiping means comprises an elongate web of wiping material held under tension on said primer applicator, a pressing member mounted on said primer applicator for movement substantially perpendicular to the surface of the workpiece and pressed against a predetermined region of said web of wiping material toward the surface of the workpiece, and pressing member moving means for moving said pressing member closer to the surface of the workpiece than said primer coating roller when the surface of the workpiece is to be wiped, and for moving said pressing roller further from the surface of the workpiece than said primer coating roller when the primer is to be applied to the surface of the workpiece, said moving means for moving said primer applicator comprising means for moving said web of wiping material through said pressing means along the surface of the workpiece while in pressed contact therewith when the surface of the workpiece is wiped.

* * * * *